US008463150B2

(12) United States Patent
Yoshikawa

(10) Patent No.: US 8,463,150 B2
(45) Date of Patent: Jun. 11, 2013

(54) FIXING DEVICE AND IMAGE FORMING APPARATUS INCORPORATING SAME

(75) Inventor: Takahiro Yoshikawa, Sagamihara (JP)

(73) Assignee: Ricoh Company Limited, Tokyo (JP)

( * ) Notice: Subject to any disclaimer, the term of this patent is extended or adjusted under 35 U.S.C. 154(b) by 477 days.

(21) Appl. No.: 12/767,212

(22) Filed: Apr. 26, 2010

(65) Prior Publication Data

US 2010/0272458 A1 Oct. 28, 2010

(30) Foreign Application Priority Data

Apr. 27, 2009 (JP) ..... 2009-107826

(51) Int. Cl.
*G03G 15/20* (2006.01)

(52) U.S. Cl.
USPC ..... 399/68

(58) Field of Classification Search
USPC ..... 399/67, 68
See application file for complete search history.

(56) References Cited

U.S. PATENT DOCUMENTS

| | | | | |
|---|---|---|---|---|
| 4,967,237 | A * | 10/1990 | Sasaki et al. | 399/322 |
| 5,210,580 | A * | 5/1993 | Aslam et al. | 399/328 |
| 5,402,211 | A | 3/1995 | Yoshikawa | |
| 5,729,818 | A | 3/1998 | Ishizuka et al. | |
| 5,850,588 | A | 12/1998 | Yoshikawa | |
| 6,160,974 | A | 12/2000 | Yoshikawa et al. | |
| 6,459,877 | B1 | 10/2002 | Yoda et al. | |
| 6,487,381 | B1 | 11/2002 | Ishizuka et al. | |
| 6,501,914 | B2 | 12/2002 | Yoshikawa | |
| 6,757,502 | B2 | 6/2004 | Yoshikawa | |
| 6,823,149 | B2 | 11/2004 | Yoshikawa et al. | |
| 7,043,185 | B2 | 5/2006 | Yoshikawa | |
| 7,127,204 | B2 | 10/2006 | Satoh et al. | |
| 7,292,801 | B2 | 11/2007 | Yoshikawa | |
| 7,313,353 | B2 | 12/2007 | Satoh et al. | |
| 7,366,456 | B2 | 4/2008 | Yoshikawa | |

(Continued)

FOREIGN PATENT DOCUMENTS

| | | |
|---|---|---|
| EP | 1 022 622 A2 | 7/2000 |
| EP | 1 022 622 A3 | 7/2000 |

(Continued)

OTHER PUBLICATIONS

Machine translation of JP2004-029563.*

(Continued)

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

A fixing device includes a fuser member, a pressure member, a first motor, a second motor, a pressure adjuster, and a controller. The fuser member defines a first heatable surface. The pressure member defines a second heatable surface. The first motor is connected to the fuser member to rotate at a first rotation rate to drive the first surface at a first conveyance speed. The second motor is connected to the pressure member to rotate at a second rotation rate to drive the second surface at a second conveyance speed. The pressure adjuster presses the pressure member against the fuser member at a variable pressure to form a fixing nip with a variable width extending along the conveyance path. The controller is connected to the first and second motors to adjust at least one of the first and second rotation rates relative to the other.

10 Claims, 8 Drawing Sheets

U.S. PATENT DOCUMENTS

| | | | | |
|---|---|---|---|---|
| 7,460,797 | B2 | 12/2008 | Yoshikawa | |
| 7,653,321 | B2 | 1/2010 | Yoshikawa | |
| 7,672,607 | B2 | 3/2010 | Yoshikawa | |
| 2005/0220473 | A1* | 10/2005 | Bott et al. | 399/67 |
| 2007/0059020 | A1 | 3/2007 | Yoshikawa | |
| 2007/0274748 | A1 | 11/2007 | Yoshikawa | |
| 2008/0075477 | A1* | 3/2008 | Kiely et al. | 399/16 |
| 2008/0101814 | A1 | 5/2008 | Yoshikawa | |
| 2009/0067869 | A1 | 3/2009 | Toyonori et al. | |
| 2009/0092409 | A1 | 4/2009 | Chiyoda et al. | |
| 2009/0148206 | A1 | 6/2009 | Yoshikawa | |
| 2010/0008683 | A1 | 1/2010 | Yoshikawa | |

FOREIGN PATENT DOCUMENTS

| | | | |
|---|---|---|---|
| EP | 1 072 964 | A1 | 1/2001 |
| JP | 57-79977 | | 5/1982 |
| JP | 63-192068 | | 8/1988 |
| JP | 10-312132 | | 11/1998 |
| JP | 2001-290382 | | 10/2001 |
| JP | 2002-214957 | | 7/2002 |
| JP | 2003-167459 | | 6/2003 |
| JP | 2004029563 | A * | 1/2004 |
| JP | 2004-139040 | | 5/2004 |
| JP | 2005-338807 | | 12/2005 |

OTHER PUBLICATIONS

Extended European Search Report issued Sep. 22, 2011, in Patent Application No. 10160282.9.

* cited by examiner

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2009-107826 filed on Apr. 27, 2009, which is hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus incorporating such a fixing device.

2. Discussion of the Background

In electrophotographic image forming apparatus, such as photocopiers, facsimiles, printers, plotters, or multifunctional machines incorporating several of those imaging functions, an image is formed by attracting toner particles to a photoconductive surface for subsequent transfer to a recording medium such as a sheet of paper. After transfer, the recording medium is forwarded to a post-transfer media conveyance path and undergoes a fixing process, which permanently fixes the toner image in place on the recording medium by melting and settling toner with heat and pressure.

Various types of fixing devices are known in the art, most of which employ a pair of parallel, elongated fixing members, at least one of which is heated and/or pressed against the other to define a line of contact called a fixing nip through which the recording medium is ultimately passed to fix the toner image in place. Such fixing members include paired cylindrical rollers and belts, typically equipped with a motor to impart rotational force to drive one of the pair, which in turn rotates the other as it drives a recording sheet through the fixing nip for forwarding along the media conveyance path.

What is required for good performance of a fixing device is to have a reliable and efficient conveyance system for conveying recording sheets upstream and downstream along the media conveyance path. Reliably conveying a recording sheet through the fixing process is difficult, since variations in processing speed through the fixing nip can cause the recording sheet to deviate from the proper path and crease or jam at the fixing nip due to poor coordination with other processes, or interfere with adjacent surfaces to distort or degrade the toner image on its printed face. Moreover, maintaining proper processing speed can put excessive loads on the drive motor, resulting in reduced power efficiency in the fixing device.

The requirement for reliable sheet conveyance is challenging, particularly for modern image forming apparatuses which use a wide range of recording sheets different in thickness, weight, roughness, and surface coating. These high-performance printers employ a fixing device that can accommodate variations in sheet type by adjusting rotation rate of the drive motor, or as in the case for high-speed printers, by adjusting width of the fixing nip along the conveyance path. Unfortunately, such changes in operating condition lead to variations in conveyance speed at the fixing nip, leading to print defects or overloading of the drive motor.

Another factor affecting sheet conveyance in the fixing process is occasional variations in conveyance speed caused by thermal deformation of the fixing members defining the fixing nip. It has been known that a fixing member or roller made of elastic rubber, which is most commonly employed, expands and contracts when heated and cooled during operation. This expansion and contraction varies the speed at which the outer circumference of the fixing member moves as the drive motor rotates at a regulated rotation rate, resulting in the conveyance speed deviating from the proper speed as specified based on the original size of the fixing member.

One approach to overcoming such problems is to alter the rotation rate of the driver motor depending on the temperature at which the fixing member is operated, so as to maintain a constant conveyance speed regardless of thermal deformation of the fixing member. However, this method has a limitation in that it cannot accommodate changes in operating condition where both of the paired fixing members exhibit different degrees of thermal deformation, resulting in print defects caused by inconsistency in conveyance speed at the fixing nip.

Sheet conveyance through the fixing process is even more complicated where the fixing device is employed in combination with a secondary fixing device that provides a glossy and smooth appearance to the fixed image after fixing, typically used for printing on coated paper sheets with high gloss and smoothness on their surfaces.

Conventionally, high gloss printing in electrophotographic printers is performed by a single fixing device that intensely heats an unfixed toner image by slowing the conveyance speed down to below half an original speed and increasing the amounts of heat and pressure applied to thoroughly fuse toner particles into a substantially uniform semi-solid mass. When cooled and fixed, the resulting image exhibits higher gloss than is obtained through the normal fixing process. Such conventional method requires extremely high nip pressure and relatively large equipment for the fixing process to obtain sufficient glossing performance while maintaining productivity at an acceptable level.

Using multiple fixing modules for glossing prints in a single printer can alleviate problems encountered by the conventional approach. That is, a multi-pass fixing method uses a relatively low pressure for each fixing module, which can therefore operate at a relatively high speed, leading to higher productivity and efficiency of glossing compared to the conventional single-pass method.

One example of such multi-pass fixing system uses a primary fixing station in combination with one or more secondary fixing stations. Printing is performed using two different modes of operation, gloss and non-gloss, wherein a recording sheet passes through only the primary fixing station in the non-gloss mode but through both primary and secondary fixing stations in the gloss mode. Such a method has a drawback in that it requires multiple conveyance paths, one for the non-gloss mode and another for the gloss-mode, which is inefficient in terms of space and complexity involved in using two conveyance paths in the single fixing system.

Another method also provides a dual-mode fixing system using primary and secondary fixing stations defining fixing nips arranged in series along a single conveyance path, at least one of which can adjust nip pressure by moving a pair of fixing members relative to each other. According to this method, the fixing stations relay a recording sheet from one to the other along a guide plate therebetween along the conveyance path in both modes of operation, and switches between operation modes by decreasing and increasing the adjustable nip pressure to obtain the desired levels of gloss.

Still another method also proposes a dual-mode fixing system using a series of primary and secondary fixing stations along a single conveyance path, but which adjusts a processing temperature of the secondary fixing station so as to keep this temperature lower than that of the primary fixing station in order to reduce power consumed in the glossing process. This method requires the primary and secondary fixing stations to be sufficiently close to each other to prevent heat from dissipating from the recording sheet in process, and only allows a limited distance between the fixing stations for disposing a guide plate to ensure good stripping of recording sheets from the primary fixing roller even in an oil-less configuration.

A common problem encountered by the conventional methods using a series of primary and secondary fixing stations along a single conveyance path is the difficulty in properly forwarding a recording sheet from the primary to secondary fixing station along the conveyance path through which the recording sheet travels with a toner image immediately after primary fixing, which is still hot and thus exhibits adhesion to adjacent surfaces such as paper guides and conveying rollers, resulting in sheet jamming as well as image distortion. This problem is more pronounced with the primary and secondary fixing stations disposed close to each other, where any inconsistency in conveyance speed between the fixing stations can crease a recording sheet being processed, with one end pinched by the secondary fixing nip and the other end by the primary fixing nip.

SUMMARY OF THE INVENTION

Exemplary aspects of the present invention are put forward in view of the above-described circumstances, and provide a novel fixing device that fixes a toner image in place on a recording medium traveling through a conveyance path.

In one exemplary embodiment, the novel fixing device includes a fuser member, a pressure member, a first motor, a second motor, a pressure adjuster, and a controller. The fuser member defines a first heatable surface rotatable to convey the recording medium therealong. The pressure member defines a second heatable surface rotatable to convey the recording medium therealong. The first motor is connected to the fuser member to rotate at a first rotation rate to drive the first surface at a first conveyance speed. The second motor is connected to the pressure member to rotate at a second rotation rate to drive the second surface at a second conveyance speed. The pressure adjuster presses the pressure member against the fuser member at a variable pressure to form a fixing nip with a variable width extending along the conveyance path. The fuser and pressure members together pass the recording sheet to fix the toner image thereon with heat and pressure through the fixing nip. The controller is connected to the first and second motors to adjust at least one of the first and second rotation rates relative to the other to keep a difference between the first and second conveyance speeds to within approximately 1%.

Other exemplary aspects of the present invention are put forward in view of the above-described circumstances, and provide a novel image forming apparatus.

In one exemplary embodiment, the novel image forming includes an electrophotographic unit and a fixing device. The electrophotographic imaging unit forms a toner image on a recording medium. The fixing device fixes the toner image in place on the recording medium traveling along a conveyance path. The fixing device includes a fuser member, a pressure member, a first motor, a second motor, a pressure adjuster, and a controller. The fuser member defines a first heatable surface rotatable to convey the recording medium therealong. The pressure member defines a second heatable surface rotatable to convey the recording medium therealong. The first motor is connected to the fuser member to rotate at a first rotation rate to drive the first surface at a first conveyance speed. The second motor is connected to the pressure member to rotate at a second rotation rate to drive the second surface at a second conveyance speed. The pressure adjuster presses the pressure member against the fuser member at a variable pressure to form a fixing nip with a variable width extending along the conveyance path. The fuser and pressure members together pass the recording sheet to fix the toner image thereon with heat and pressure through the fixing nip. The controller is connected to the first and second motors to adjust at least one of the first and second rotation rates relative to the other to keep the first and second conveyance speeds substantially equal.

Other exemplary aspects of the present invention are put forward in view of the above-described circumstances, and provide a method for operating a fixing device that fixes a toner image in place on a recording medium.

In one exemplary embodiment, the fixing device includes a fuser member and a pressure member. The fuser member defines a first heatable surface rotatable by a first motor to convey the recording medium therealong. The pressure member defines a second heatable surface rotatable by a second motor to convey the recording medium therealong. The fuser and pressure members are pressed against each other to form a fixing nip along a conveyance path through which the recording medium travels to fix the toner image thereon with heat and pressure. The method includes steps of first motor rotation, second motor rotation, and adjustment. The first motor rotation rotates the first motor at a first rotation rate to drive the first surface at a first conveyance speed. The second motor rotation rotates the second motor at a second rotation rate to drive the second surface at a second conveyance speed. The adjustment adjusts at least one of the first and second rotation rates to keep the first and second conveyance speeds substantially equal.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
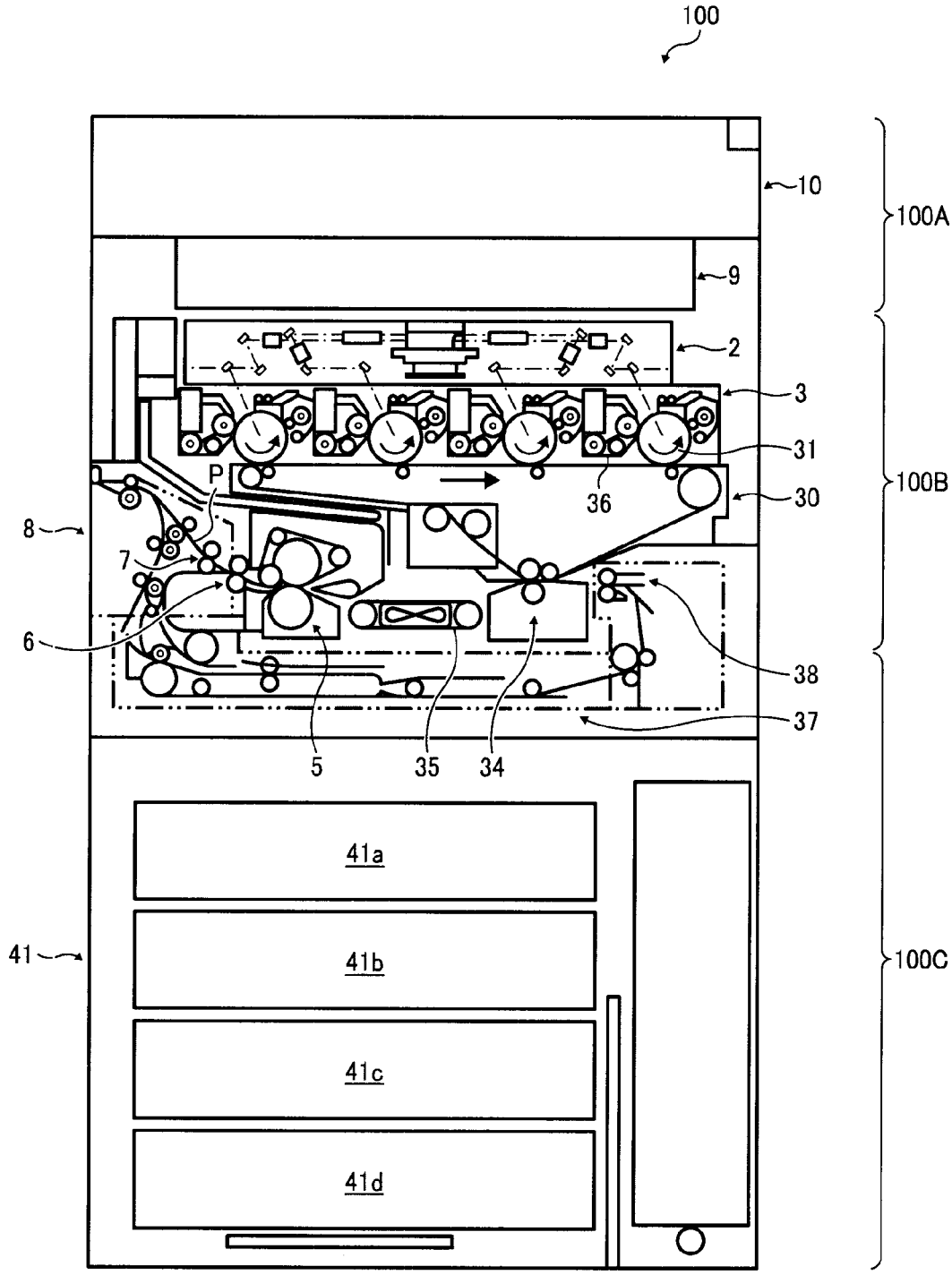
FIG. 1 schematically illustrates an example of an image forming apparatus incorporating a fixing device according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an example of an image forming apparatus 100 incorporating a fixing device 5 according to this patent specification.

As shown in FIG. 1, the image forming apparatus 100 is a digital imaging system in which various functionalities are combined together to form a freestanding unit, with an image scanning section 100A at the top, a printer section 100B in the middle, and a sheet feeding section 100C at the bottom.

The scanning section 100A includes an optical scanner 9 and an automatic document feeder (ADF) 10 to which an original document is supplied by a user. The ADF 10 can convey original documents in succession for processing through the scanner 9, which then optically scans the face of the original to capture image data of subtractive primary colors (i.e., red, green, and blue) for forwarding to the printer section 100B.

The printer section 100B comprises a tandem color printer that forms a color image by combining images of yellow, magenta, and cyan (i.e., the complements of the three primary colors) as well as black. The printer section 100B includes four imaging stations 4 adjacent to a write scanner 2, arranged in series substantially laterally along the length of an intermediate transfer belt 30.

Each imaging station 4 includes a drum-shaped photoconductor 31 rotatable counterclockwise in the drawing, surrounded by various pieces of imaging equipment 3, such as a charging device, a development device accommodating toner, a primary transfer device, etc., to form an image with toner particles of a particular color on the photoconductive surface for transfer to the intermediate transfer belt 30, as well as a drum cleaner 36 to clean the photoconductive surface after image transfer.

The intermediate transfer belt 30 is trained around a motor-driven roller and other support rollers to rotate clockwise in the drawing with its outer surface passing through the series of imaging stations 4 while in contact with a secondary transfer roller 34 located opposite one of the belt support rollers.

Also included in the printer section 100B are a fixing device 5 and a secondary fixing or glossing device 6 according to this patent specification, as well as a conveyance belt 35 and a pair of conveyance rollers 7 together defining a post-transfer sheet conveyance path P along which a recording medium S, such as a sheet of paper, travels from between the intermediate transfer belt 30 and the secondary transfer roller 34 through the fixing device 5 and then the glossing device 6 for output outside the apparatus body through an ejection unit 8.

The sheet feeding section 100C includes multiple sheet trays 41*a* through 41*d* each accommodating a stock of recording sheets, as well as multiple rollers, including a pair of registration rollers 38, or similar conveyor parts, together defining a pre-transfer sheet conveyance path 37 along which a recording sheet travels from the sheet tray 41 to between the intermediate transfer belt 30 and the secondary transfer roller 34.

During operation, in the printer section 100B, each imaging station 4 rotates the photoconductor drum 31 to pass the photoconductive surface through a series of imaging processes. Initially, the photoconductive surface is charged by the charging device to a given uniform potential, and then selectively discharged by the optical scanner 2 to form an electrostatic latent image according to image data supplied externally or forwarded from the scanning section 100A. Subsequently, the developing device applies toner to the photoconductive surface to render the latent image into a visible toner image, which is then primarily transferred to the surface of the intermediate transfer belt 30 under an electrostatic field.

Such imaging and transfer processes take place in the respective imaging stations 4 as the intermediate transfer belt 30 rotates, so that the transferred toner images are superimposed one atop another to form a single composite image on the moving belt surface. The multicolor toner image thus obtained is forwarded to the secondary transfer roller 34.

In the sheet feeding section 100C, a recording sheet travels along the pre-transfer conveyance path 37 from the sheet tray 41 to between the pair of registration rollers 38. The roller pair 38 holds the incoming sheet for deskewing and registration, and then forwards it to the secondary transfer roller 34 in coordination with the intermediate transfer belt 30 forwarding the toner image. As a result, the toner image is secondarily transferred to the recording sheet between the intermediate transfer belt 30 and the secondary transfer roller 34.

After secondary transfer, the recording sheet advances along the post-transfer conveyance path P into the fixing device 5 and then into the glossing device 6. The fixing device 5 fixes the toner image in place on the recording sheet with heat and pressure, followed by the glossing device 6 processing the sheet with heat to provide gloss to the fixed image if required. Afterwards, the finished print is conveyed by the rollers 7 to outside the apparatus body through the ejection unit 8, which completes one operational cycle of the image forming apparatus 100.

According to this patent specification, the image forming apparatus 100 can selectively print a recording sheet S of a given thickness or weight per ream either in a gloss mode or in a non-gloss mode, for example, according to a user specifying the mode of operation through a display monitor or any suitable user interface.

To print a sheet of glossy paper such as coated paper that has a relatively high gloss ranging from approximately 30 to 50%, the image forming apparatus 100 operates in the gloss mode to form an image with as much gloss as the surface of the paper in use has, which is suitable for printing gravure pictures. To print a sheet of normal copy paper with a relatively low gloss, the image forming apparatus 100 operates in the non-gloss mode to form an image without gloss, which is suitable for printing text or the like.

Such glossing process is performed using the fixing device 5 and the glossing device 6 arranged along the post-transfer conveyance path P, each of which can operate in different ways depending on the operation mode specified as well as the type of recording sheet in use, so as to provide good fixing and glossing performance for a wide range of recording sheets accommodated in the image forming apparatus 100, as will be described later in more detail.

Figure 2:
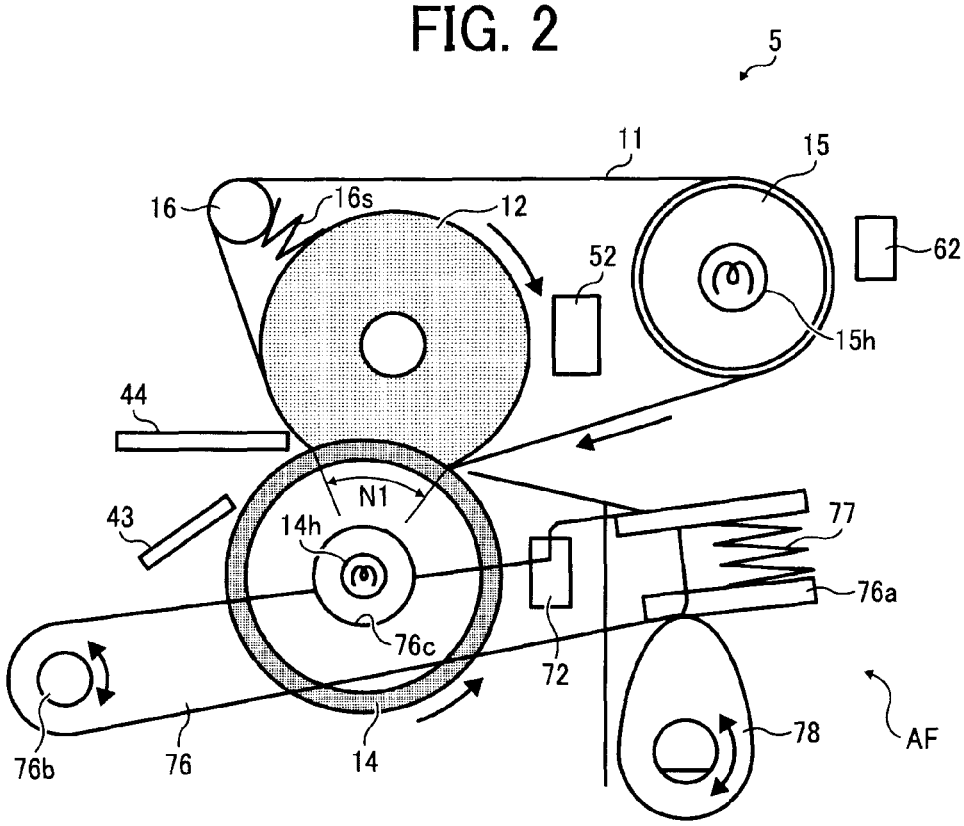
FIG. 2 is an end-on, axial view schematically illustrating the fixing device according to one embodiment of this patent specification.

FIG. 2 is an end-on, axial view schematically illustrating the fixing device 5 according to one embodiment of this patent specification.

As shown in FIG. 2, the fixing device 5 includes a motor-driven pressure roller 14 internally heated with a heater 14*h* and rotatable counterclockwise in the drawing, and a motor-driven fuser roller 12 rotatable clockwise in the drawing around which an endless, fuser belt 11 is looped for rotation with the fuser roller 12. The fuser belt 11 is heated with a heat roller 15 heated with a heater 15*h* and tensioned with a tension roller 16 loaded with a spring 16*s*.

The fixing device 5 also includes a pressure adjuster AF that presses the pressure roller 14 against the fuser roller 12 through the fuser belt 11 at a variable pressure to form a fixing nip N1 with a variable width extending along the post-transfer conveyance path P. Sheet separators 43 and 44 are disposed along the conveyance path P downstream of the fixing nip N1, the former having an end angled with respect to the pressure roller 14 and the latter having an end angled with respect to the fuser belt 11.

Specifically, the fuser belt 11 comprises a multi-layered endless belt formed of a substrate of suitable material with high resistance to heat, low coefficient of thermal expansion, and relatively high strength, such as nickel, stainless steel, and preferably polyimide, covered with an intermediate layer of elastic material such as silicone rubber, and an outer layer of release agent such as fluorocarbon resin that effects good stripping of toner from the outer surface. For example, a triple-layered belt approximately 100 mm long along its inner circumference may be used, consisting of a substrate of polyimide resin, an intermediate layer of silicone rubber approximately 200 μm thick, and an outer layer of tetra fluoro ethylene-perfluoro alkylvinyl ether copolymer or Perfluoroalkoxy (PFA) deposited thrcugh tube coating or other coating method.

The fuser roller 12 comprises a cylindrical roller formed by covering a hollow, cylindrical metal core with a layer of heat-resistant, elastic material, such as silicone rubber in the form of solid, sponge, or foam. For example, a roller approximately 65 mm in diameter formed of a metal cylinder coated with silicone foam approximately 14 mm in thickness may be used. A thermometer 52 to sense temperature of the roller surface before entering the fixing nip N1 is disposed near the fuser roller 12.

The tension roller 16 is held against the inner circumference of the looped belt 11 rotating past the fuser roller 12 toward the heat roller 15. The roller 16 serves to maintain an adequate tension on the fuser belt 11, for example, by exerting a tension of approximately 9.8 N at opposing sides of its length to apply a total tension of approximately 19.6 N across the width of the fuser belt 11.

The heat roller 15 comprises a hollow cylindrical roller formed of suitable material, such as aluminum or iron. For example, a hollow aluminum cylinder approximately 35 mm in diameter and approximately 0.6 mm in radial thickness may be used. The heater 15*h* may include any heat source, such as a halogen heater or an induction heater, and be disposed inside the hollow roller 15 or any location inside the belt loop adjacent the heat roller 15 and apart from the fixing nip N1 where the belt 11 is pressed between the fixing rollers 12 and 14. A thermometer 62 to sense temperature of the surface of the fuser belt 11 being heated with the roller 15 is disposed near the heat roller 15.

The pressure roller 14 comprises a cylindrical roller formed of a hollow, cylindrical core of aluminum or iron covered with a layer of heat-resistant, elastic material, such as silicone rubber in the form of solid, sponge, or foam. For example, a roller approximately 65 mm in diameter may be used, consisting of a hollow, cylindrical metal core approximately 1 mm in radial thickness covered with an inner layer of silicone rubber approximately 1.5 mm in thickness, and an outer layer of PFA deposited through tube coating or other suitable coating methods.

Disposed near the pressure roller 14 is a thermometer 72 to sense temperature of the roller surface, according to which the roller heater 14*h* switches on and off to maintain the surface temperature at a sufficiently high level so as to prevent the roller surface from absorbing heat from a recording sheet S within the fixing nip N1. Optionally, the pressure roller 14 may have a web cleaning unit, not shown, that removes residual toner and paper dust from the roller surface, where required.

The pressure adjuster AF includes a pressure lever 76 having an intermediate member 76*a* at one end, a hinge 76*b* at the other end, and a bearing 76*c* between the free and hinged ends to support the axis of the pressure roller 14. The pressure adjuster AF also has a spring 77 connected to the free end of the lever 76 through the intermediate member 76*a*, and a cam 78 connected to a suitable driving mechanism, not shown, that imparts rotational force from outside the fixing device 5. The pressure adjuster AF may be configured without the spring 77, in which case the cam 78 connects to the free end of the lever 76 through the intermediate member 76*a*.

The pressure adjuster AF may hold the pressure roller 14 against the fuser roller 12 through the belt 11 to establish the fixing nip N1 between the roller 14 and the belt 11, or away from the fuser roller 12 to create a gap between the roller 14 and the belt 11. When pressed against the fuser roller 12, the pressure roller 14 digs a certain depth (e.g., approximately 2 to 4 mm) into the fuser roller 12 through the thickness of belt 11. Thus, the fixing nip N1 has a certain width along the sheet conveyance path P (i.e., along the circumferences of the rollers), and the extent of this width varies proportionally with the nip pressure.

During operation, the fuser roller 12 rotates to drive the tension-looped fuser belt 11 clockwise in the drawing, while the pressure roller 14 rotates counterclockwise in the drawing in pressure contact with the fuser belt 11. The fuser belt 11 is heated to a temperature sufficient to melt toner particles as it rotates with the heat roller 15 heated by the internal heater 15*h* controlled according to readings of the thermometer 62. The pressure roller 14 is heated to a sufficiently high temperature by the internal heater 14*h*.

As a recording sheet S with a toner image thereon enters the fixing nip N1, the fuser roller 12 and the pressure roller 14 with the fuser belt 11 therebetween together drive the incoming sheet S forward along the conveyance path P (from right to left in FIG. 2). Within the fixing nip N1, heat and pressure melt the toner particles for settling in place on the surface of the incoming sheet S. After fixing, the recording sheet S is stripped off from the surface of the fuser belt 11 by the separator 44 or from the surface of the pressure roller 14 by the separator 43, to proceed along the conveyance path P toward the glossing device 6.

As mentioned, the pressure adjuster AF can press the pressure roller 14 against the fuser roller 12 at a variable nip pressure to establish a variable nip width N1, when adjusted by rotating the cam 78 to vary position of the pressure lever 76 holding the axis of the pressure roller 14.

For example, the nip pressure is increased by rotating the cam 78 counterclockwise in the drawing to force the intermediate member 76*a* upward, which in turn causes the spring 77 to press the free end of the pressure lever 76 upward, resulting in the lever 76 swiveled around the hinge 76*b* counterclockwise in the drawing. As the pressure lever 76 thus rotates, the pressure roller 14 moves toward the fuser roller 12 to establish a higher nip pressure and a wider fixing nip N1.

Conversely, the nip pressure is decreased by rotating the cam 78 clockwise in the drawing to allow the intermediate member 76*a* to move downward, which in turn causes the spring 77 to relieve the upward pressure against the free end of the pressure lever 76, resulting in the lever 76 swiveled around the hinge 76*b* clockwise in the drawing. As the pressure lever 76 thus rotates, the pressure roller 14 moves away from the fuser roller 12 to establish a lower nip pressure and a narrower fixing nip N1.

Such adjustment of nip pressure allows the fixing device 5 to adjust the width of the fixing nip N depending on the mode of operation in which the image forming apparatus 100 is operated, or depending on the gloss of recording sheet S being used for printing.

Figure 3:
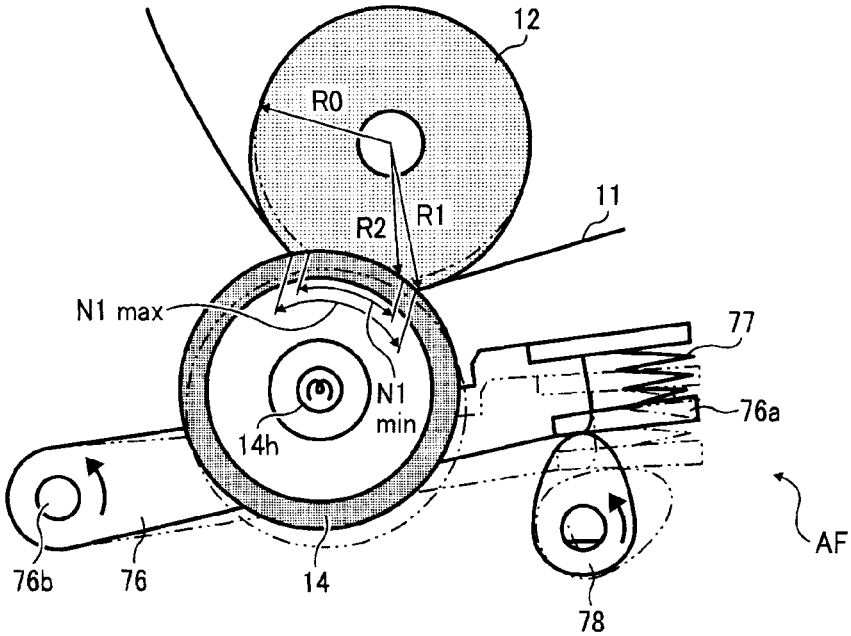
FIG. 3 is an enlarged, partial schematic view of the fixing device of FIG. 2.

Thus, as can be seen with reference to FIG. 3, the fixing device 5 establishes a relatively deep, wide, long fixing nip where the image forming apparatus 100 processes a sheet of gloss coated paper in the gloss mode (as indicated by solid lines), and a relatively shallow, narrow, short fixing nip where the image forming apparatus 100 processes a sheet of normal copy paper in the non-gloss mode (as indicated by broken lines).

With a constant conveyance speed at which the recording sheet S travels along the conveyance path P, the width of the fixing nip N is proportional to the length of nip dwell time during which the traveling sheet S is passed under heat through the fixing nip N. Thus, a larger nip width results in a longer dwell time and larger amount of heat applied to the recording sheet S within the fixing nip N1, which provides higher gloss to a resulting image. Conversely, a smaller nip width results in a shorter dwell time and smaller amount of heat applied to the recording sheet S within the fixing nip N1, which provides lower gloss to a resulting image.

Specifically, the fixing device 5 adjusts the nip width in the gloss mode so that an image past the fixing nip N1 has a gloss ranging from approximately 10% to approximately 30%, preferably from approximately 20% to approximately 30%, and more preferably from approximately 25% to approximately 30% or less. Such arrangement ensures a sufficient level of gloss of a finalized image printed on a glossy sheet.

Further, the fixing device 5 can adjust the nip width depending on the thickness of recording sheet in use to provide a desired appearance or gloss level in either mode of operation.

Specifically, the fixing device 5 establishes a relatively long fixing nip N1 where the recording sheet in use is relatively thick (e.g., a paper sheet weighing approximately 120 to approximately 300 g/m$^2$), and a relatively short fixing nip N1 where the recording sheet in use is relatively thin or of normal thickness.

In a conventional configuration, processing various types of recording sheets without adjusting a fixing nip for varying thickness of recording sheets results in excessive amounts of heat applied to relatively thin recording sheets, or insufficient amounts of heat supplied to relatively thick recordings sheets. Excessive heating can result in undesirably glossy prints obtained through the non-gloss mode operation, whereas insufficient heating can result in insufficient fixing or glossing in the gloss mode operation.

By contrast, with the present invention, the fixing device 5 adjusts the nip width to prevent overheating thinner recording sheets and underheating thicker recording sheets through the fixing nip N1, so as to maintain constant amounts of gloss on resulting prints in both operation modes regardless of the type of recording sheet in use.

For example, with a nip pressure ranging from approximately 15 to approximately 30 N/cm$^2$, the fixing device 5 establishes a relatively long fixing nip N1 of approximately 20 mm in the gloss mode, and a relatively short fixing nip N1 of approximately 15 mm in the non-gloss mode, resulting in a total dwell time of 50 milliseconds or longer during which the recording sheet S travels through the fixing nip N at a given linear speed.

Thus, owing to the fixing nip with a variable nip width and dwell time, the fixing device 5 according to this patent specification can adjust appearance of images depending on the mode of operation and the type of recording sheet in use, leacing to excellent fixing and glossing performance with high speed and high productivity, and a wide range of recording sheets accommodated in the image forming apparatus 100.

Figure 4:
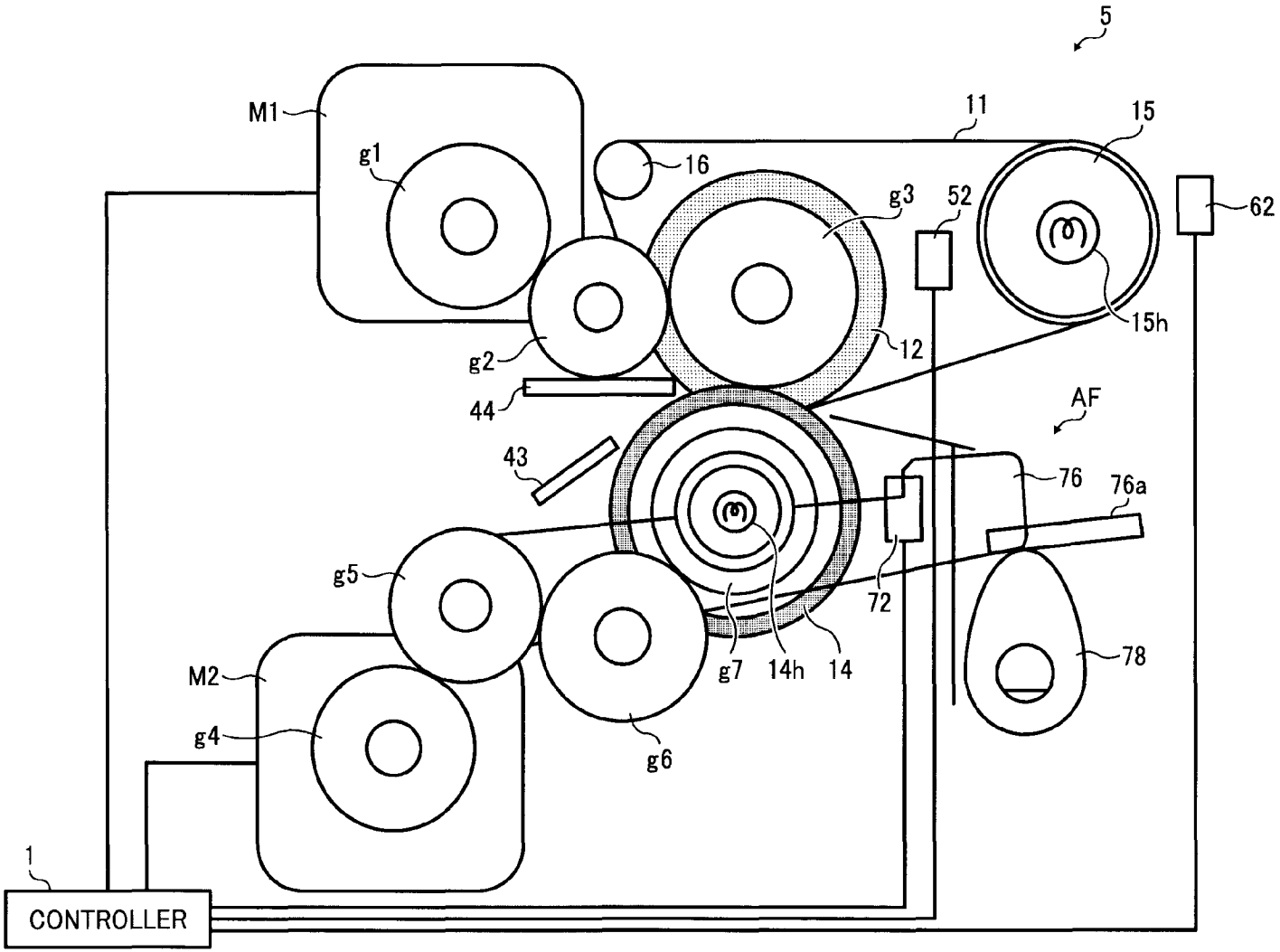
FIG. 4 is another schematic view illustrating the fixing device of FIG. 2.

FIG. 4 is another schematic view illustrating the fixing device 5 according to this patent specification.

As shown in FIG. 4, the fixing device 5 includes a first motor M1 connected to the fuser roller 12 through a series of gears g1 though g3, and a second motor M2 connected to the pressure roller 14 through a series of gears g4 through g7, as well as a controller 1 operably connected to the first and second motors M1 and M2 and to the thermometers 52, 62, and 72.

The first motor M1 rotates at a first rotation rate to impart rotational force via the gears g1 through g3 to the fuser roller 12, which in turn rotates the fuser belt 11 with the belt supporting rollers 15 and 16 to pass through the fixing nip N1 at a first linear conveyance speed VF1 along the roller circumference. The second motor M2 rotates at a second rotation rate to impart rotational force via the gears g4 through g7 to the pressure roller 14 to pass through the fixing nip N1 at a second linear conveyance speed VF2 along the roller circumference.

The controller 1 adjusts at least one of the rotation rates of the first and second motors M1 and M2 relative to the other so as to prevent inconsistency between the first and second conveyance speeds VF1 and VF2 of the paired fixing members caused by various factors, which can result in print defects and/or excessive wear on the fixing members.

One important factor that can cause inconsistency between the conveyance speeds VF1 and VF2 is variations in diameter of the fixing rollers, occurring when the fixing device 5 changes the nip pressure and width to adjust for the mode of operation selected or the type of recording sheet in use.

With additional reference to FIG. 3, the fixing device 5 can set the pressure roller 14 to multiple operational positions to vary the width of the fixing nip N1 through the pressure adjuster AF, including a first extreme position in which the axis of the pressure roller 14 is closest to that of fuser roller 12 to define a fixing nip with a maximum width Nimax (represented by solid lines), and a second extreme position in which the axis of the pressure roller 14 is farthest from that of fuser roller 12 to define a fixing nip with a minimum width Nimin (represented by broken lines).

Note that the fuser roller 12, which in the present embodiment has a relatively thick layer of elastic material and therefore is more pliant than the pressure roller 14, deforms under pressure at the fixing nip N1, so that its radii at the edges of the fixing nip N1 differ from its nominal radius R0 outside the fixing nip N1 to a certain degree, depending on the position of the pressure roller 14 relative to the fuser roller 12.

Specifically, when the pressure roller 14 is in the first extreme position to define the longest fixing nip N1max, the fuser roller 12 deforms significantly, with the radius R1 at the edges of the fixing nip considerably greater than the nominal radius R0. Conversely, when the pressure roller 14 is in the second extreme position to define the shortest fixing nip N1min, deformation of the fuser roller 12 is relatively small, with the radius R2 at the edges of the fixing nip slightly greater than the nominal radius R0 and smaller than the radius R1 by several millimeters.

In contrast to the fuser roller 12, the pressure roller 14, which in the present embodiment has a relatively thin layer of elastic material and therefore is stiffer than the pressure roller 14, substantially maintains its original shape and radius regardless of the position and the width of the fixing nip N1.

For a given rotation rate of the motor M1 driving the fuser roller 12, the longer radius R1 yields a relatively high linear speed along the roller circumference, and the shorter radius R2 yields a relatively low linear speed along the roller circumference. Thus, driving the fuser roller 12 at a constant rotation rate would result in the roller 12 conveyance speed varying depending on the relative position of the pressure roller 14. On the other hand, the pressure roller 14 maintains a substantially constant conveyance speed for a given rotation rate of the motor M2 regardless of the relative position of the fuser roller 12.

In a conventional configuration where a single roller motor drives a pair of fixing rollers, one relatively pliant and the other relatively stiff, at a given rotation rate, the rotation rate is specified so that the paired fixing members have their surfaces moving at an identical conveyance speed in a certain operational position, for example, in which they define a widest fixing nip.

In such cases, varying relative positions of the paired rollers for adjusting nip pressure and width can result in inconsistency in conveyance speed between the fixing rollers. That is, the rollers would rotate at a substantially identical linear speed when in the operational position with the maximum nip width. However, once the rollers are positioned to define a shorter, narrower fixing nip, the pliant roller has a linear speed smaller than that of the stiff roller due to a decrease in its radius, resulting in abrasion of the fixing members defining the fixing nip and distortion of an image printed on the recording sheet.

Moreover, such inconsistency in conveyance speed at the fixing nip can adversely affect sheet conveyance through processes neighboring the fixing process along the conveyance path. For example, decelerating the sheet conveyance in the fixing process causes a sheet forwarded from the transfer process to interfere with guide plates or other surrounding structures upstream of the fixing process, resulting in concomitant sheet jamming or creasing at the fixing nip. On the other hand, accelerating the sheet conveyance in the fixing process causes a sheet to prematurely exit the transfer process, resulting in distortion or expansion of a printed image, as well as sheet creasing due to pronounced misalignment between the transfer and fixing processes.

It is known that a recording sheet, when driven by a pair of fixing members at different conveyance speeds, tends to move at a traveling speed closer to the conveyance speed of that fixing member against which it exhibits a higher friction coefficient than the other. The friction coefficient on the surface of a fixing member depends on various operational conditions including physical properties of materials involved in the fixing process, such as toner, recording medium, lubricant oil, etc. This results in difficulty in determining the traveling speed of the recording sheet as a variable dependent on the conveyance speed of a particular fixing member, making it even more difficult to reliably convey various types of recording sheets through fixing and neighboring processes.

To overcome the problems encountered by conventional configurations, the fixing device 5 according to this patent specification adjusts the rotation rates of the first and second motors M1 and M2 relative to each other based on the pressure between the fuser and pressure members 12 and 14, so as to regulate a difference between the conveyance speeds VF1 and VF2 of the paired fixing members to substantially 0, for example, to within approximately 1% of each other. This allows the fixing device 5 to reliably convey recording sheets without print defects, regardless of changes in the operating condition.

Preferably, the controller 1 accomplishes relative adjustment of the motor rotation rates by holding the rotation rate of the second motor M2 constant while varying the rotation rate of the first motor M1 depending on the radius of the fuser roller 12 at the fixing nip N1. For example, decelerating the first motor M1 for the longest roller radius R1 and accelerating the first motor M1 for the shortest roller radius R2 may eliminate a difference between the roller circumferential conveyance speeds VF1 and VF2 efficiently, without changing the rotation rate of the second motor M2.

The above-described arrangement effectively prevents print defects due to inconsistent circumferential speeds at the fixing nip without affecting the transfer process upstream from the fixing process, particularly where the pressure roller 14 determines the sheet conveyance speed in the fixing device 5 which is synchronized with neighboring imaging processes.

In addition to those caused by nip pressure variations, variations in diameter of the fixing rollers can also occur due to thermal deformation of materials forming the outer layers of the fixing members, which expand and contract when heated and cooled during operation of the fixing device 5.

Specifically, in the fixing device 5, the fuser roller 12 has its surface continuously supplied with heat by conduction from the rotating fuser belt 11 heated by the heat roller 15, and deprived of heat upon contacting a recording sheet S entering the fixing nip N. As a result, the outer layer of the fuser roller 12 is at a relatively high, constant temperature during a waiting period before entrance of a recording sheet S into the fixing nip N1, and at a relatively low, constant temperature during a processing period where a recording sheet S passes (or more precisely starts entering) the fixing nip N.

Such variations in temperature result in variations in diameter of the fuser roller 12, and thus variations in the conveyance speed of the fuser belt 11 entrained along the circumference of the fuser roller 12. As the temperature of the fuser roller 12 during operation is determined by various factors, such as the thickness and material of recording sheet in use and the speed at which the sheet passes through the fixing nip, the degree of conveyance speed variations of the fuser belt 11 varies from operation to operation depending on those operational factors.

On the other hand, the pressure roller 14 has its surface continuously supplied with heat by conduction from the internal heater 14*h*, and deprived of heat upon contacting a recording sheet S entering the fixing nip N. In the configuration where heating of the pressure roller 14 is auxiliary to that of the fuser belt 11 directly heating toner images on recording sheets, the heater 14*h* provides the roller 14 with a relatively modest amount of heat, smaller than that absorbed by a recording sheet S in contact with the roller surface. As a result, the outer layer of the pressure roller 14 gradually cools during a processing period where a recording sheet S passes through the fixing nip N, to a temperature lower than that obtained during a waiting period before entrance of a recording sheet S into the fixing nip N1.

As is the case for the fuser roller 12, such variations in temperature result in variations in diameter of the pressure roller 14, and thus variations in the conveyance speed of the pressure roller 12 during processing.

Thus, the fixing rollers 12 and 14 forming the fixing nip N1 in the fixing device 5 have their respective diameters varying as they are heated and cooled during operation. Without appropriate correction, these variations would lead to inconsistencies between the conveyance speeds VF1 and VF2, and concomitant print defects on a resulting print processed through the fixing nip.

To alleviate such problems, the fixing device 5 according to this patent specification adjusts the rotation rates of the first and second motors M1 and M2 relative to each other based on the surface temperature of at least one of the fuser and pressure members 12 and 14, so as to regulate a difference between the conveyance speeds VF1 and VF2 of the paired fixing members to substantially 0, for example, to within approximately 1% from each other. This allows the fixing device 5 to reliably convey recording sheets without print defects, regardless of changes in temperature between waiting and processing periods during operation.

Specifically, the controller 1 calculates variations in diameter of the fuser roller 12 according to readings of the thermometer 52 sensing temperature of the surface of the fuser roller 12. Such calculation may, for example, be based on a difference between temperatures measured before entrance of a recording sheet S into the fixing nip N1 and during passage of the recording sheet S into the fixing nip N1.

Also, the controller 1 may calculate variations in diameter of the pressure roller 14 according to the readings of the thermometer 52, or alternatively, based on the operating state of the heater 15*h* of the roller 15 heating the fuser belt 11. Such configuration is possible where the temperature of the pressure roller 14 within the fixing nip N1 is appreciably influenced by heating of adjacent surfaces of the fuser belt 11 and the fuser roller 12.

Thus, the controller 1 adjusts the rotation rates of the first and second motors M1 and M2 relative to each other based on variations in diameter of the rollers 12 and 14 determined based on the surface temperature of the fuser roller 12.

Alternatively, instead of the thermometer 52 sensing the surface temperature of the fuser roller 12, it is also possible to use the sensor 62 sensing temperature of the fuser belt 11 to indirectly determine the surface temperature of the roller 12 for calculating variations in roller diameters.

As in the embodiment described above, relative adjustment of the motor rotation rates may be accomplished by holding the rotation rate of the second motor M2 constant while varying the rotation rate of the first motor M1. Such arrangement effectively prevents print defects due to inconsistent circumferential speeds at the fixing nip without affecting the transfer process upstream from the fixing process, particularly where the pressure roller 14 determines the sheet conveyance speed in the fixing device 5 which is coordinated with neighboring imaging processes.

In a further embodiment, the fixing device 5 adjusts the rotation rates of the first and second motors M1 and M2 relative to each other based on amount of torque required to drive either one of the fuser and pressure members 12 and 14, so as to regulate a difference between the conveyance speeds VF1 and VF2 of the paired fixing members to substantially 0, for example, to within approximately 1% from each other.

Such control is based on the principle that deviation in the amount of torque or electricity supplied to force the roller motors M1 and M2 from a rated value indicates inconsistency between the conveyance speeds VF1 and VF2, which typically causes increased friction between the fixing members. That is, when the conveyance speeds VF1 and VF2 are unequal, the fuser belt 11 and the pressure roller 14 have their surfaces rubbing against each other, resulting in increased torques of the roller motors M1 and M2. Contrarily, when the conveyance speeds VF1 and VF2 are substantially equal, the fuser belt 11 and the pressure roller 14 have their surfaces contacting without undue friction, resulting in the torques of the roller motors M1 and M2 substantially maintained at the rated value.

Thus, maintaining the motor torques around their rated value results in the conveyance speeds VF1 and VF2 being maintained substantially equal to each other. For example, maintaining the torque of each motor with a deviation approximately ±10% or less from the rated value maintains a difference between the conveyance speeds VF1 and VF2 to approximately 1% or less through the fixing nip N1.

As in the embodiments depicted above, relative control of the motor rotation rates may be accomplished, for example, by holding the rotation rate of the second motor M2 at a given fixed value, and varying the rotation rate of the first motor M1 to reduce deviation of the torque of the second motor M2 from the rated value. Such arrangement effectively prevents print defects due to inconsistent circumferential speeds at the fixing nip without affecting the transfer process upstream from the fixing process, particularly where the pressure roller 14 determines the sheet conveyance speed in the fixing device 5 which is synchronized with neighboring imaging processes.

More preferably, the controller 1 has a list of appropriate rotation rates of the first motor M1 with which the second motor M2 can operate without undue torque, provided as a function of nip pressure with which the pressure roller 14 presses against the fuser roller 12. Further, where the second motor M2 is operated at a constant rotation rate, the controller 1 may also have a list of appropriate ratios between the rotation rates of the first and second motors M1 and M2 with respect to the nip pressure.

Compared to adjusting the rotation rate of the motor M1 based on the motor torque measured during operation, the listing of optimum rotation rates or ratios of such values allows the controller 1 to promptly determine the rotation rates of the motors M1 and M2 relative to each other upon activation of the fixing device 5, according to the nip pressure between the rollers 12 and 14. This enables the fixing device 5 to operate reliably at an appropriate processing speed as soon as an initial sheet enters the fixing nip N1, regardless of the relative positions of the rollers 12 and 14 forming the fixing nip N1.

Still more preferably, the controller 1 has a list of appropriate rotation rates of the first motor M1 with which the second motor M2 can operate without undue torque, provided as a function of changes in temperature of the surface of the pressure roller 12 before and after the fixing device 5 starts processing recording sheets through the fixing nip N1. Further, where the second motor M2 is operated at a constant rotation rate, the controller 1 may also have a list of appropriate ratios between the rotation rates of the first and second motors M1 and M2 with respect to the roller temperature.

Compared to adjusting the rotation rate of the motor M1 based on the motor torque measured during operation, the listing of optimum rotation rates or ratios of such values allows the controller 1 to promptly determine the rotation rates of the motors M1 and M2 relative to each other as the fixing device 5 starts processing through the fixing nip N1, according to changes in temperature of the surface of the fuser roller 12, indicating variations in diameter of the rollers 12 and 14 that affect relative positions of the rollers 12 and 14. This enables the fixing device 5 to operate reliably at an appropriate processing speed soon after an initial sheet enters the fixing nip N1, regardless of the relative positions of the rollers 12 and 14 forming the fixing nip N1.

Figure 5:
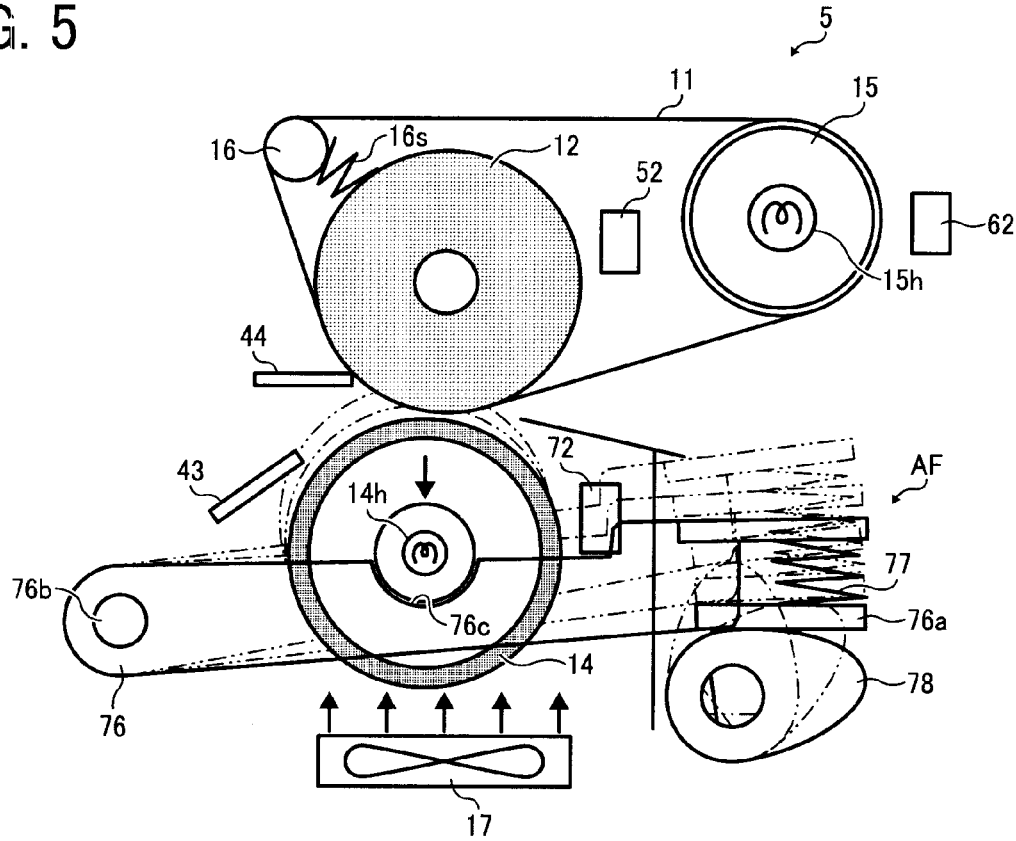
FIG. 5 is a schematic view illustrating the fixing device according to a still further embodiment of this patent specification.

FIG. 5 is a schematic view illustrating the fixing device 5 according to a still further embodiment of this patent specification.

As shown in FIG. 5, the fixing device 5 may include a cooler 17 disposed adjacent to the pressure roller 14 and away from the fuser roller 12 to cool only the pressure roller 14 with its surface held stationary away from the fuser belt 11 in a first cooling mode, and both of the fuser and pressure rollers 12 and 14 by cooling the pressure roller 14 with its surface rotating in contact with the fuser belt 11 in a second cooling mode.

The cooler 17 may be a mechanical fan that generates an airflow to blow across the surface of the pressure roller 14. In addition to the purposes as described herein, such a cooler may serve to cool the surface of the pressure roller 14 in contact with a printed face of a recording sheet S during duplex printing, which prevents inconsistencies in gloss of images formed on first and second sides of a duplex printed sheet.

Specifically, in the first cooling mode, the fixing device 5 holds the pressure roller 14 in a retracted position away from the fuser belt 11 as represented by solid lines in FIG. 5, while simultaneously cooling the circumference of the pressure roller 14 with the cooler 17 and heating the pressure roller 14 with the internal heater 14*h*. Upon starting processing through the fixing nip N, the fixing device 5 resumes the pressure roller 14 into contact with the fuser belt 11 and stops cooling with the cooler 17, while controlling the rotation rates of the first and second motors M1 and M2 so that the conveyance speeds VF1 and VF2 remain substantially equal to each other.

In the second cooling mode, the fixing device 5 holds the pressure roller 14 against the fuser roller 12 through the fuser belt 11 as represented by broken lines in FIG. 5, while simultaneously cooling the circumference of the pressure roller 14 with the cooler 17, which in turn absorbs heat from the circumference of the fuser roller through the fuser belt 11. Upon starting processing through the fixing nip N, the fixing device 5 controls the rotation rates of the first and second motors M1 and M2 so that the conveyance speeds VF1 and VF2 remain substantially equal to each other.

As mentioned, the fuser roller 12 has its surface gaining a relatively large amount of heat from the fuser belt 11 heated by the heat roller 15 to remain at substantially constant temperatures during waiting and processing periods, so that the diameter of the fuser roller 12 remains substantially constant during waiting and processing periods. By contrast, the pressure roller 14 has its surface heated by the internal heater 14*h* and cooled upon contacting recording sheets entering the fixing nip N1.

Cooling the circumference of the pressure roller 14 before processing maintains the temperature of the roller surface at a level with which the pressure roller 14 may operate during processing, so that there is substantially no change in temperature of the circumference of the pressure roller 14 as the fixing device 5 starts processing recording sheets through the fixing nip N1. This prevents the diameter of the pressure roller 14 from decreasing during processing due to a gradual decrease in surface temperature of the pressure roller 14, which in turn prevents variations in the conveyance speed VF2, and thus inconsistency between the conveyance speeds VF1 and VF2 and concomitant print defects during conveyance through the fixing nip N1.

Moreover, the fixing device 5 varies the temperature of the fuser roller 12 from one level to another depending on operational conditions, such as the material and thickness of recording sheet in use. Simply switching off the heater 15*h* of the heat roller 15 can cool the roller 12 gradually to an equilibrium temperature as a certain number of recording sheets pass through the fixing nip N1 to absorb heat from the fuser roller 12, which, however, would result in gradually decreasing the diameter of the roller 12 before the equilibrium temperature is reached, leading to inconsistency between the conveyance speeds VF1 and VF2.

Cooling the circumference of the fuser roller 12 in the second cooling mode when the fixing device 5 changes its processing temperature allows the temperature of the roller surface to swiftly reach a level with which the fuser roller 12 may operate during processing, so that there is substantially no change in temperature of the circumference of the fuser roller 12 as the fixing device 5 starts processing recording sheets through the fixing nip N1. This prevents the diameter of the fuser roller 12 from decreasing during processing due to a gradual decrease in surface temperature of the pressure roller 12, which in turn prevents variations in the conveyance speed VF1, and thus inconsistency between the conveyance speeds VF1 and VF2 and concomitant print defects during conveyance through the fixing nip N1.

Thus, the fixing device 5 according to this specification can effectively minimize a difference between the conveyance speeds VF1 and VF2 of the fuser and pressure members defining a fixing nip N1 with a variable nip width along the sheet conveyance path P, owing to the separate roller motors M1 and M2 having their rotation rates controlled relative to each other by the controller 1 based on various factors causing variations in operating conditions.

Moreover, such controllability of the conveyance speeds VF1 and VF2 allows for compensating for variations in the processing speed of the fixing device 5 relative to the neighboring processes in the image forming apparatus 100, caused by varying friction coefficient on the surface of a fixing member depending on various operational conditions including physical properties of materials involved in the fixing process, such as toner, recording medium, lubricant oil, etc., leading to reliable sheet conveyance along the conveyance path.

Although the embodiments above describe a fixing device with a pair of rollers pressed against each other through an endless belt looped around one of the paired rollers, the dual-motor fixing system according to this patent specification is applicable to various configurations of fixing devices, for example, those as described below with reference to FIGS. 6 through 8.

Figure 6:
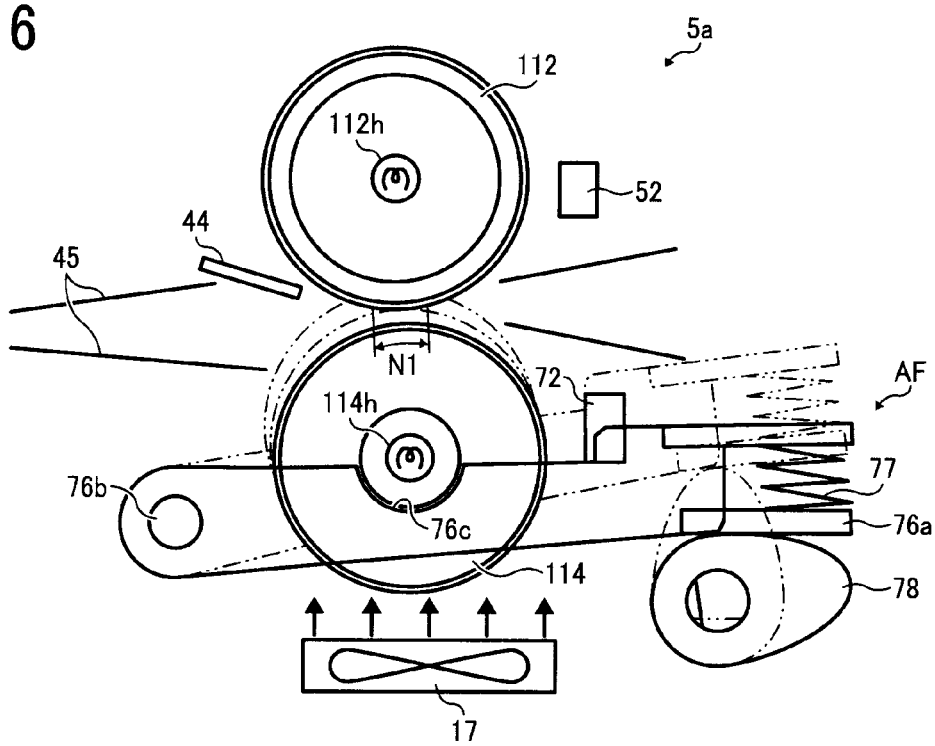
FIG. 6 is an end-on, axial view schematically illustrating a yet still further embodiment of a fixing device according to this patent specification.

FIG. 6 is an end-on, axial view schematically illustrating a yet still further embodiment of a fixing device 5*a* according to this patent specification.

As shown in FIG. 6, the present embodiment is similar to that depicted primarily with reference to FIGS. 2 though 5, except that it employs a pressure roller 114 and a fuser roller 112 pressed directly against each other to form a fixing nip N1 with adjustable nip pressure and width, in place of the pressure roller 14 and the fuser roller 12 pressed together through the fuser belt 11 looped around the roller 12 as well as the heat roller 15 and the tension roller 16.

Specifically, the fuser roller 112 comprises a roller formed by covering a hollow, cylindrical metal core with a layer of heat-resistant, elastic material, such as silicone rubber in the form of solid, sponge, or foam. The fuser roller 112 is driven for rotation clockwise in the drawing by the first motor M1 with its circumference heated by conduction from an internal heater 112*h*. The thermometer 52 is directed toward the surface of the fuser roller 112 before entering the fixing nip N1 to sense the temperature of the roller circumference for transmission to the controller 1, which switches on and off the heater 112*h* according to the readings of the thermometer 52.

The pressure roller 114 comprises a roller similar to that depicted in the embodiment above, formed of a hollow, cylindrical core of aluminum or iron covered with a layer of heat-resistant, elastic material, such as silicone rubber in the form of solid, sponge, or foam. The pressure roller 114 is driven for rotation counterclockwise in the drawing by the second motor M2, not shown, with its circumference heated by conduction from an internal heater 114*h* and cooled by the cooler 17 where required. The thermometer 72 is directed toward the surface of the roller 114 to sense the temperature of the roller circumference for transmission to the controller 1, which switches on and off the heater 114*h* according to the readings of the thermometer 72.

Figure 7:
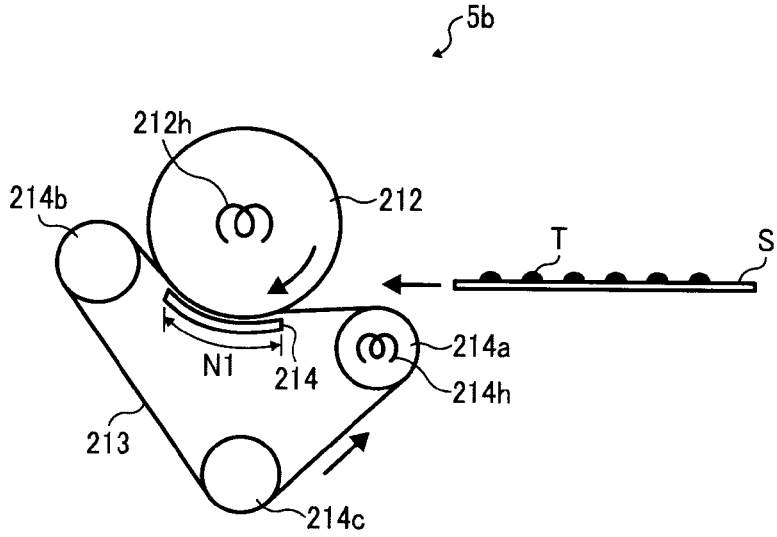
FIG. 7 is an end-on, axial view schematically illustrating a yet still further embodiment of a fixing device according to this patent specification.

FIG. 7 is an end-on, axial view schematically illustrating a yet still further embodiment of the fixing device 5*b* according to this patent specification.

As shown in FIG. 7, the present embodiment is similar to that depicted primarily with reference to FIGS. 2 though 5, except that it employs a pressure pad 214 and a fuser roller 212 pressed against each other through a pressure belt 213 looped around the pressure pad 214 as well as multiple rollers 214*a*, 214*b*, and 214*c* to form a fixing nip N1 with adjustable nip pressure and width, in place of the pressure roller 14 and the fuser roller 12 pressed together through the fuser belt 11 trained around the roller 12 as well as the heat roller 15 and the tension roller 16.

Specifically, the fuser roller 212 comprises a roller formed by covering a hollow, cylindrical metal core with a layer of heat-resistant, elastic material, such as silicone rubber in the form of solid, sponge, or foam. The fuser roller 212 is driven for rotation clockwise in the drawing by the first motor M1, not shown, with its circumference heated by conduction from an internal heater 212*h*. Although not depicted in the drawing, the thermometer 52 is directed toward the surface of the fuser roller 212 before entering the fixing nip N1 to sense the temperature of the roller circumference for transmission to the controller 1, which switches on and off the heater 212*h* according to the readings of the thermometer 52.

The pressure belt 213 has its support roller 214*b* driven for rotation counterclockwise in the drawing by the second motor M2, with its circumference heated by another support roller 214*a* internally heated with a heater 214*h*, and where required, cooled by the cooler 17, not shown. The pressure pad 214 comprises an elongated member extending across the width of the pressure belt 213 and formed of any suitable material to provide backing to the belt 213. Although not depicted in the drawing, the thermometer 72 is directed toward the surface of the pressure belt 213 to sense the temperature of the belt circumference for transmission to the controller 1, which switches on and off the heater 214H according to the readings of the thermometer 72.

Figure 8:
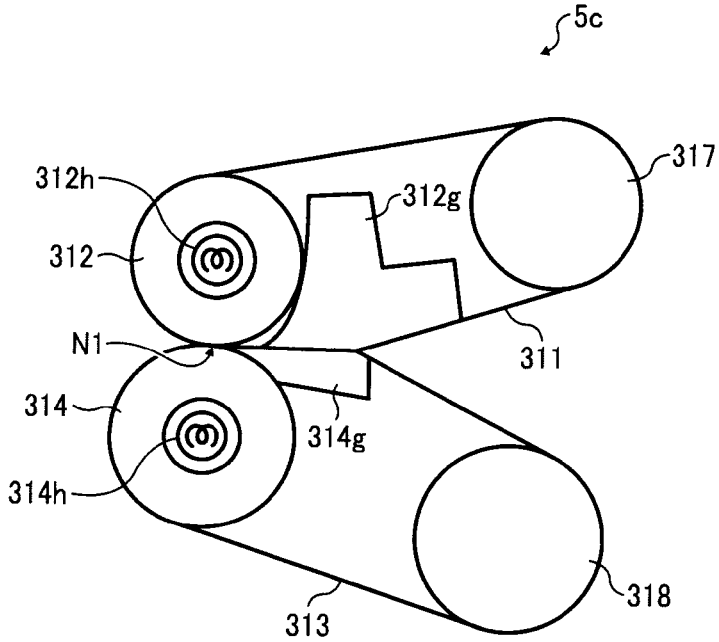
FIG. 8 is an end-on, axial view schematically illustrating a yet still further embodiment of a fixing device according to this patent specification.

FIG. 8 is an end-on, axial view schematically illustrating a yet still further embodiment of the fixing device 5*c* according to this patent specification.

As shown in FIG. 8, the present embodiment is similar to that depicted primarily with reference to FIGS. 2 though 5, except that it employs a fuser roller 312 and a pressure roller 314 both internally heated and pressed against each other through a pair of endless belts 311 and 313, the former looped around the fuser roller 312 and the latter around the pressure roller 314, to form a fixing nip N1 with adjustable nip pressure and width, in place of the pressure roller 14 and the fuser roller 12 pressed together through the fuser belt 11 trained around the roller 12 as well as the heat roller 15 and the tension roller 16.

Specifically, the fuser belt 311 is trained around the roller 312 as well as a roller 317 and a guide 312*g* for rotation clockwise in the drawing as the fuser roller 312 is driven by the first motor M1. The fuser roller 312 has its circumference heated by conduction from an internal heater 312*h*, which in turn heats the length of the rotating belt 311. Although not depicted in the drawing, the thermometer 52 is directed toward the surface of the roller 312 before entering the fixing nip N1 to sense the temperature of the roller circumference for transmission to the controller 1, which switches on and off the heater 312*h* according to the readings of the thermometer 52.

The pressure belt 313 is trained around the pressure roller 314 as well as a roller 318 and a guide 314*g* for rotation counterclockwise in the drawing as the roller 318 is driven by the second motor M2. The pressure roller 314 has its circumference heated by conduction from an internal heater 314*h*, which in turn heats the length of the rotating belt 313. Where required, the circumference of the pressure roller 314 is cooled by airflow from the cooler 17. Although not depicted in the drawing, the thermometer 72 is directed toward the surface of the roller 314 to sense the temperature of the roller circumference for transmission to the controller 1, which switches on and off the heater 314*h* according to the readings of the thermometer 72.

Figure 9:
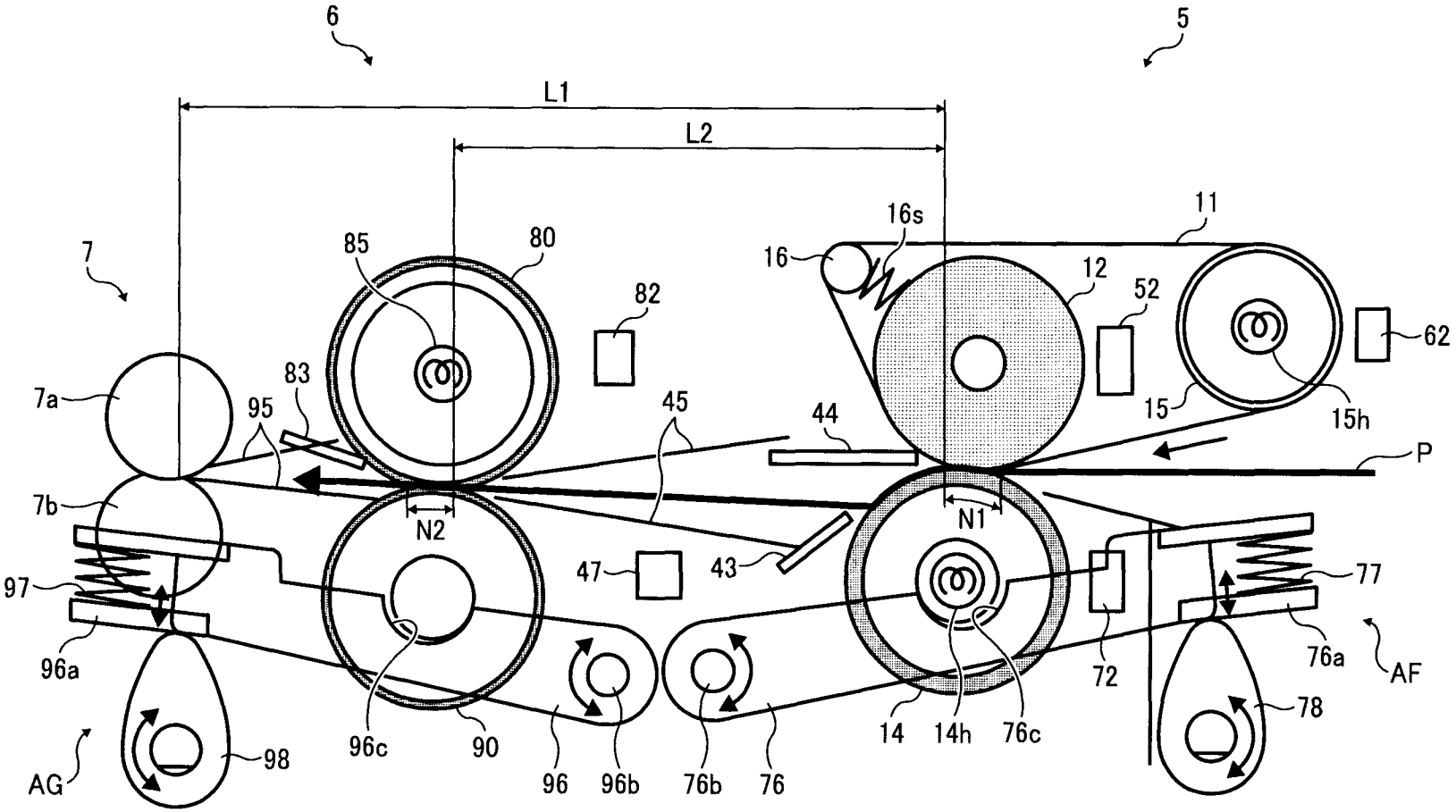
FIG. 9 is an end-on, axial view schematically illustrating the fixing device employed in combination with a glossing device 6 in the image forming apparatus of FIG. 1.

Referring now to FIG. 9, there is seen the fixing device 5 employed in combination with the glossing device 6 in the image forming apparatus 100 according to this patent specification.

As shown in FIG. 9, the fixing device 5 and the glossing device 6 are arranged in series from upstream to downstream in the post-transfer conveyance path P along which a recording sheet S travels in a direction of arrow from the transfer process toward the conveyance roller pair 7.

The fixing device 5 in the present embodiment is configured in the manner as depicted primarily with reference to FIGS. 2 through 5, wherein the fuser roller 12 and the pressure roller 14 are pressed against each other through the fuser belt 11 with the pressure adjuster AF to form the fixing nip N1 along the conveyance path P, while independently driven for rotation by the first and second motors M1 and M2, respectively.

Between the fixing device 5 and the glossing device 6 is a pair of guide plates 45 each angled with respect to the plane of sheet conveyance path P, with their opposing surfaces defining a tapered passage therebetween narrowing from upstream to downstream to introduce a recording sheet S from the fixing device 5 toward the glossing device 6. The guide plate pair 45 may be used alone as shown in FIG. 9, or in tandem with another pair of similar guide plates 46 (see FIG. 10).

Similarly, between the glossing device 6 and the conveyance roller pair 7 is a pair of guide plates 95 each angled with respect to the plane of sheet conveyance path P, with their opposing surfaces defining a tapered passage therebetween narrowing from upstream to downstream to introduce a recording sheet S from the glossing device 6 toward the conveyance roller pair 7.

The conveyance roller pair 7 includes a first roller 7*a* formed of a cylindrical body of elastic material, such as chloroprene rubber or silicone rubber, and a second roller 7*b* formed of a cylindrical body of plastic material, either or both of which rotates in contact with each other to forward a recording sheet along the post-transfer conveyance path P downstream from the glossing nip N2. The roller pair 7 is located within a distance L1 (e.g., 210 mm, which equals the length of the shorter edge of an A4-size copy sheet) from a downstream end of the fixing nip N1, which allows for reliable and efficient conveyance of relatively long recording sheets along the conveyance path P in the non-gloss mode as will be described later in more detail.

Specifically, in the image forming apparatus 100, the glossing device 6 includes an internally heated roller 80 and a pressure roller 90, with the pressure roller 90 being pressed against the heat roller 80 by a pressure adjuster AG at a variable pressure to form a glossing nip N2 with a variable width along the conveyance path P downstream from the fixing nip N1. The glossing device 6 is disposed so that an upstream end of the glossing nip N2 is located within a distance L2 from a downstream end of the fixing nip N1.

More specifically, in the glossing device 6, the heat roller 80 comprises a hollow, cylindrical roller formed of an elongated core of suitable metal, such as aluminum or iron, covered with an outer layer of elastic material such as silicone rubber. A sheet separator 83 is disposed at the exit of the glossing nip N2, with an end angled with respect to the heat roller 80.

The heat roller 80 has its circumference heated by conduction from an internal heater 85, such as a halogen heater, disposed along the elongated metal core. A thermometer 82 is provided adjacent to the circumference of the heat roller 80 that senses temperature of the roller surface, according to which the heater 85 switches on and off to maintain the roller surface at an appropriate temperature.

The pressure roller 90 comprises a cylindrical roller formed of an elongated core of suitable metal, such as aluminum or iron, covered with an outer layer of elastic material such as silicone rubber. The pressure roller 90 is equipped with the pressure adjuster AG used to adjust a pressure across the glossing nip N2 in a manner similar to that of the pressure adjuster AF in the fixing device 5.

The pressure adjuster AG includes a pressure lever 96 having an intermediate member 96*a* at one end, a hinge 96*b* at the other end, and a bearing 96*c* between the free and hinged ends to support the axis of the pressure roller 90. The pressure adjuster AG also has a spring 97 connected to the free end of the lever 96 through the intermediate member 96*a*, and a cam 98 connected to a suitable driving mechanism, not shown, that imparts rotational force from outside the glossing device 6. The pressure adjuster AG may be configured without the spring 97, in which case the cam 98 connects to the free end of the lever 96 through the intermediate member 96*a*.

As in the case of the pressure adjuster AF for the fixing device 5, the pressure adjuster AG can press the pressure roller 14 against the fuser roller 12 at a variable nip pressure to establish a variable nip width N2, when adjusted by rotating the cam 98 to vary position of the pressure lever 96 holding the axis of the pressure roller 90.

For example, the nip pressure is increased by rotating the cam 98 clockwise in the drawing to force the intermediate member 96*a* upward, which in turn causes the spring 97 to press the free end of the pressure lever 96 upward, resulting in the lever 96 swiveled around the hinge 96*b* clockwise in the drawing. As the pressure lever 96 thus rotates, the pressure roller 90 moves toward the heat roller 80 to establish a higher nip pressure and a wider glossing nip N2.

Conversely, the nip pressure is decreased by rotating the cam 98 counterclockwise to in the drawing to allow the intermediate member 96*a* to drop downward, which in turn causes the spring 97 to relieve the upward pressure against the free end of the pressure lever 96, resulting in the lever 96 swiveled around the hinge 96*b* counterclockwise in the drawing. As the pressure lever 96 thus rotates, the pressure roller 90 moves away from the heat roller 80 to establish a lower nip pressure and a shorter glossing nip N2.

Thus, the pressure across the glossing nip N2 is adjusted by rotating the cam 98 to move the pressure roller 90 toward or away, or out of contact with the heat roller 80.

Preferably, in the gloss mode where the glossing device 6 serves to gloss over a printed image through treatment with heat and pressure, the nip pressure is in the range of approximately 15 N/cm$^2$ to approximately 30 N/cm$^2$ on average acrcss the glossing nip N2. In the non-gloss mode where the glossing device 6 serves to forward a recording sheet without glossing, the nip pressure is lower than that for the gloss mode, preferably, lower than approximately 15 N/cm$^2$, and more preferably, lower than approximately 5 N/cm$^2$ on average acrcss the glossing nip N2.

During operation, a recording sheet S bearing a toner image after transfer travels through the fixing device 5, the glossing device 6, and the conveyance rollers 7 in sequence along the post-transfer conveyance path P.

As the recording sheet S enters the fixing nip N1, the fuser roller 12 and the pressure roller 14 with the fuser belt 11 therebetween together drive the incoming sheet S forward along the conveyance path P (from right to left in FIG. 9). Within the fixing nip N1, heat and pressure melt the toner particles for settling in place on the surface of the incoming sheet S, which then proceeds to the glossing device 6 along the conveyance path P.

During passage from the fixing device 5 to the glossing device 6, the sheet separator 44 effectively strips off the recording sheet S from the belt surface to guide it into the conveyance path P in case the molten toner exhibits adhesion to the surrounding surfaces.

Further, should the recording sheet S cling to the pressure roller 14, which is more likely the case for duplex printing of relatively large image areas on a first page and relatively small image areas on a second page, the sheet separator 43 strips off the recording sheet S from the roller surface to guide it into the conveyance path P.

Furthermore, should the recording sheet S have a curl or bent on the leading edge upon exiting the fixing nip N1, the tapered sheet passage defined between the angled guide plates 45 corrects such deformation to direct the leading edge of the sheet S straight along the conveyance path P, thereby introducing the sheet S into the glossing device 6 reliably without creasing or jamming.

In the glossing device 6, the heat roller 80 rotates clockwise in the drawing, while the pressure roller 90 rotates counterclockwise in the drawing in variable pressure contact with the heat roller 80. The heat roller 80 has its outer surface heated to a glossing temperature lower than that of the fuser belt 11 in the fixing device 5.

The glossing device 6 varies the pressure across the glossing nip N2 with the pressure adjuster AG depicted above depending on the mode of operation as well as on the size of the recording medium S passing through the glossing nip N2.

In the gloss mode, the rotating rollers 80 and 90 advances the incoming sheet S therethrough under pressure, with the printed face of the sheet S brought in contact with the smooth surface of the heat roller 80 maintained at the glossing temperature to exert a relatively moderate amount of heat sufficient to re-melt the surface of the fixed toner layer, thereby leveling and smoothing the image surface to obtain gloss on the resulting image.

In the non-gloss mode, the incoming sheet S passes through the glossing nip N2 with no or relatively low pressure applied thereon, which only drives the sheet S forward without imparting gloss on the resulting image.

After passing through the glossing nip N2, the recording sheet S travels on along the post-transfer path P as the conveyance rollers 7*a* and 7*b* rotate to advance it therebetween. Should the recording sheet S have a curl or bent on the leading edge upon exiting the glossing nip N2, the tapered sheet passage defined between the angled guide plates 95 corrects such deformation to direct the leading edge of the sheet S straight along the conveyance path P, thereby introducing the sheet S toward the conveyance roller pair 7 reliably without creasing and jamming.

The glossing temperature at which the heat roller 80 is operated is relatively moderate, so that fusing is accomplished only superficially and without entirely melting the toner layer or deteriorating the color of toner, or causing the toner layer to develop excessive adhesion to the fuser roller 80, compared to the fixing device 5 that fuses toner particles intensely and thoroughly into a viscous layer settling on the recording sheet, with a smooth but not glossy surface exhibiting greater adhesion.

Preferably, such glossing temperature is lower than that of the surface of the fuser belt 11 that fuses toner in contact with the surface of a recording sheet, or more specifically, lower than that of the surface of recording sheet exiting the fixing device 5 and higher than that of the surface of recording sheet entering the glossing device 6.

Alternatively, the glossing temperature is in a range determined based on thermal properties of toner used in the image forming apparatus 100, such as above a softening point and below a midpoint between fusing and super-fusing points of toner in use, and preferably, above a softening point and below a fusing point of toner in use.

Thermal properties of toner may be measured using a low tester, for example, a commercially available capillary and slit die rheometer "SHIMADZU FLOWTESTER model CFT500D" (manufactured by Shimadzu Corporation), which measures viscosity of a molten material based on a flow rate at which a sample of the melt is extruded from a cylinder through a capillary die under constant pressure and rising temperature to determine a softening temperature at which toner becomes sufficiently soft with heat, a fusing temperature at which toner melts into a fluid phase, and a super-fusing temperature at which extrusion of the melt completes during measurement. For example, measurements may be carried out under the following conditions: pressure force of 5 kgf/cm$^2$; temperature rise rate of 3.0° C./min.; die diameter of 1.00 mm; and die length of 10.0 mm.

For example, where the toner in use has a softening point of 60° C., a fusing point of 120° C., and a midpoint between fusing and super-fusing points of 137° C., the glossing temperature may be in a range of approximately 60° C. to approximately 137° C., more preferably, in a range of approximately 60° C. to approximately 120° C., and most preferably, in a range of approximately 80° C. to approximately 100° C. It will be appreciated that the values depicting thermal properties of toner herein are typical average values, given only by way of example, and the properties of toner used in the image forming apparatus 100 may vary by various factors, such as production conditions and types of colorant and additives used.

Setting the processing temperature of the glossing device 6 in the moderate range eliminates the need for certain structures that are included in a typical fixing device, which leads to a simple and cost-effective design of the glossing device 6. For example, low adhesion of the gloss finished surface allows for good separation of the recording sheet S from the heat roller 80 even with a dianeter in the range of 30 mm to 40 mm, in which case the provision of the sheet separator 83 is unnecessary. Moreover, superficial fusing prevents molten toner from contaminating neighboring surfaces, which eliminates the need for regularly cleaning the surface of the pressure roller 90.

Moderate heating in the glossing device 80 also means that the recording sheet S has its printed face cooled sufficiently to a temperature equal to or lower than that upon exiting the fixing nip N1, which prevents undesirable adhesion of toner to the surfaces of the conveyance rollers 7 and the guide plates 95 downstream from the glossing nip N2.

Additionally, the glossing device 6 may serve as an auxiliary to the fixing device 5 depending on the material and thickness of recording sheet in use as well as the conveyance speed at which the recording sheet travels through the conveyance path, particularly when processing a thick recording sheet weighing 124 g/m$^2$ or more at a relatively high conveyance speed, in which case the fixing device 5 forwards a recording sheet with a toner image fixed only partially through the fixing nip N1 to the glossing device 6, which then process the incoming sheet to completely fix the toner image in place.

Figure 10:
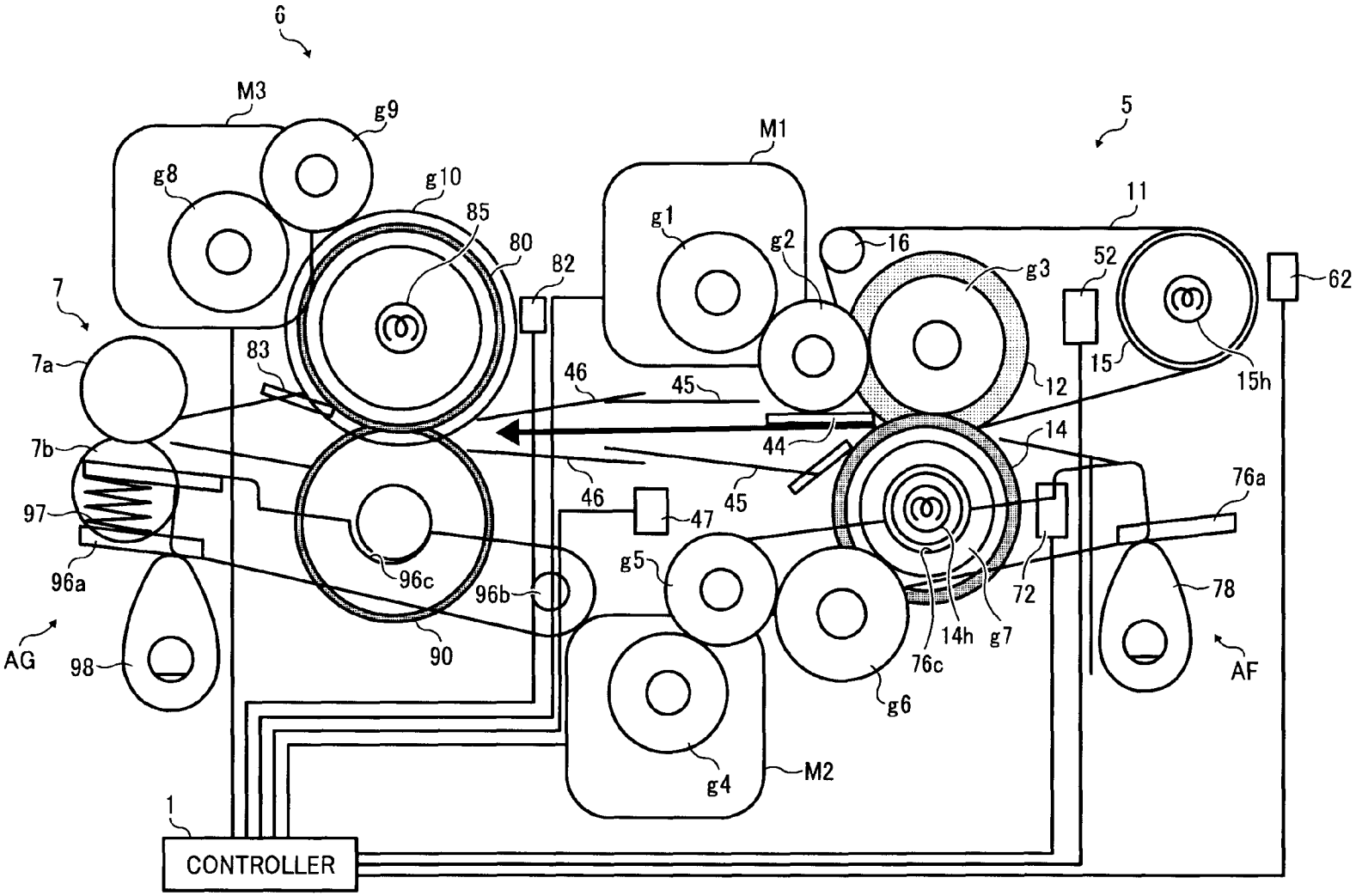
FIG. 10 is another schematic view of the fixing device employed in combination with the glossing device in the image forming apparatus 100 of FIG. 9.

FIG. 10 is another schematic view of the fixing device 5 employed in combination with the glossing device 6 in the image forming apparatus 100 according to this patent specification.

As shown in FIG. 10, the glossing device 6 includes a third motor M3 connected to the pressure roller 80 through a series of gears g8 through g10, separate from the first and second roller motors M1 and M2 of the fixing device 5. The third motor M3 is operably connected to the controller 1, which controls the first and second roller motors M1 and M2 of the fixing device 5 as depicted above with reference to FIG. 4. The third motor M3 rotates at a third rotation rate to impart rotational force via the gears g8 through g10 to the heat roller 80, which rotates with the pressure roller 90 to pass a recording sheet S through the glossing nip N2 at a third linear conveyance speed VG along the roller circumference.

The controller 1 adjusts the rotation rate of the third motor M3 relative to at least one of the first and second roller motors M1 and M2 of the fixing device 5 so as to prevent lack of coordination between processing speeds VF and VG of the fixing and glossing members caused by various factors, which can result in improper sheet conveyance along the conveyance path P.

As used herein, the processing speed VF of the fixing device 5 denotes a speed at which the fixing device 5 conveys or processes a recording sheet S through the fixing nip N1 along the conveyance path P, which may be identical to either of the conveyance speeds VF1 and VF2 of the paired rollers 12 and 14 of the fixing device 5. Considering the fact that in several embodiments of this patent specification, the pressure roller 14 has a stiffer outer layer, and therefore has a relatively constant conveyance speed than that of the fuser roller 12 in the fixing device 5, the following description assumes the processing speed VF of the fixing device 5 as equivalent to the conveyance speed VF2 of the pressure roller 14. However, such assumption is only for simplicity of illustration, and the processing speed VF may denote the conveyance speed VF1 of the fuser roller 12 depending on specific configuration.

Similarly, the processing speed VG of the glossing device 6 denotes a speed at which the glossing device 6 conveys or processes a recording sheet S through the glossing nip N2 along the conveyance path P, which may be identical to either of the conveyance speeds of the paired rollers 80 and 90 of the glossing device 6. Considering the fact that in several embodiments of this patent specification, the heat roller 80 has a stiffer outer layer, and therefore has a relatively constant conveyance speed than that of the pressure roller 90 in the glossing device 6, the following description assumes the processing speed VG of the glossing device 6 as equivalent to the conveyance speed of the heat roller 80. However, such assumption is only for simplicity of illustration, and the processing speed VG may denote the conveyance speed of the heat roller 90 depending on specific configuration.

In the glossing device 6, pressing together the heat roller 80 and the pressure roller 90, the former having the outer circumference stiffer than the latter, deforms the more pliant pressure roller 90 to cause it to define a radius smaller than a nominal radius at the edge of the glossing nip N2 where it comes into contact with the other heat roller 80, as in the case of the fixing device 5 described above with reference to FIG. 3.

Such deviation in roller radius translates into deviation in circumferential speed of the pressure roller 90 from a rated value, which can result in a lack of coordination between the fixing device 5 and the glossing device 6, and in particular, a failure to properly forward a recording sheet from the fixing nip N1 to the glossing nip N2.

To alleviate such problems, the image forming apparatus 100 according to this patent specification adjusts at least one of the motor rotation rates of the second and third motors M2 and M3 relative to the other to regulate a ratio between the processing speeds VF and VG of the fixing and glossing devices 5 and 6.

Specifically, when the fixing device 5 conveys a recording sheet through the fixing nip N1 at the processing speed VF, and the glossing device 6 conveys a recording sheet through the glossing nip N2 at the processing speed VG, the controller 1 controls the second motor M2 and the third motor M3 relative to each other so as to adjust a difference or ratio between the processing speeds VG and VF to satisfy the following Equation 1:

$$1.00 \leq VG/VF \leq 1.02 \qquad \text{Eq. 1}$$

Holding the speed ratio VG/VF in this range enables the glossing device 6 to draw and stretch a recording sheet passing between the fixing nip N1 and the glossing nip N2 without undue tension. When the processing speed VF of the fixing device 5 is greater than the processing speed VG of the glossing device 6 (i.e., VG/VF<1.00), a recording sheet after exiting the fixing nip N1 may bend, curl, or warp upon entry into the glossing nip N2, resulting in paper creases and concomitant degradation of resulting print. When the processing speed VF of the fixing device 5 is excessively smaller than the processing speed VG of the glossing device 6 (i.e., VG/VF>1.02), a recording sheet may develop creases extending diagonally from edges to center, and other print defects caused by improper conveyance between the fixing and glossing processes.

Preferably, relative adjustment of the processing speeds VF and VG is accomplished by holding a fixed rotation rate of the second motor M2 and varying a rotation rate of the third motor M3. Changing the rotation rate or processing speed VF of the fixing roller is undesirable because such a change in the fixing process can interfere with the transfer process forming a transfer nip between two moving surfaces at which a toner image is transferred to a recording sheet upstream from the fixing nip. This is particularly true where the image forming apparatus 100 processes a relatively large recording sheet, e.g., an A3- or super A3-(13×19-inch) size copy sheet, which, when conveyed with its longer side oriented along the conveyance path, extends along the conveyance path with its leading end entering the fixing nip and trailing end still in the transfer nip.

More preferably, control of the rotation rates of the roller motors M2 and M3 is performed based on the amount of electricity or torque required to rotate the corresponding rollers 14 and 80, for example, by keeping the current flow below certain rated maximum limits specified for the respective motors.

Moreover, the controller 1 may control the rotation rates of the second and third motors M2 and M3 based on a list of appropriate values for the processing speeds VF and VG, provided as a function of operational conditions, such as temperature, relative rotation rates, or the like.

Still more preferably, the controller 1 controls the rotation rates of the roller motors M2 and M3 relative to each other according to surface temperatures of the fixing and glossing rollers 14 and 80 as measured by the corresponding thermometers 72 and 82.

Specifically, the controller 1 calculates variations in the processing speed VF of the fixing device 5 caused by thermal expansion and contraction of the outer circumference of the pressure roller 14 based on readings of the thermometer 72 measuring the surface temperature. Also, the controller 1 calculates variations in the processing speed VG of the glossing device 6 caused by thermal expansion and contraction of the outer circumference of the heat roller 80 based on readings of the thermometer 82 measuring the surface temperature. The controller 1 then varies the rotation rates of the roller motors M2 and M3 to accommodate variations in the processing speeds VF and VG as thus measured.

Still more preferably, the controller 1 has a list of appropriate rotation rates of the first through third motors M1 through M3, or ratios of such values, or other properties of recording sheets accommodated in the image forming apparatus 100, with which a recording sheet S can travel throughout the fixing and glossing processes properly without bending or curling to interfere with adjacent structures.

Figure 11:
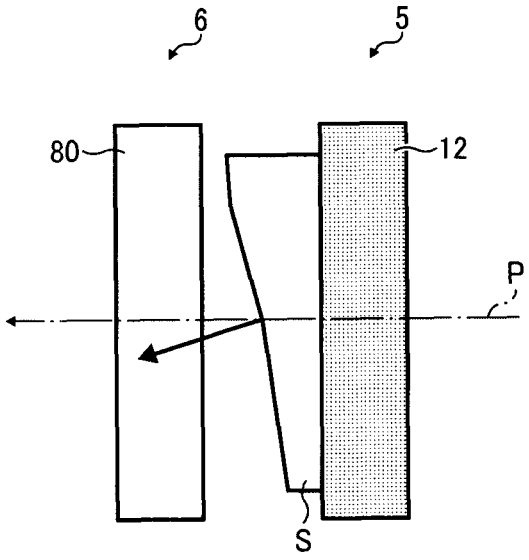
FIG. 11 schematically illustrates a recording sheet deviating from a proper conveyance path between the fixing and glossing devices.

Optimizing the rotation rates of the roller motors M1 through M3 based on a list of predefined values allows the fixing device 5 and the glossing device 6 to relay recording sheets from one nip to the other reliably and swiftly upon starting processing through the conveyance path P regardless of the type of recording sheet in use. Such arrangement effectively eliminates print defects occurring as the recording sheet bends or curls to interfere with adjacent surfaces, e.g., those of the guide plates 45, and eventually deviates from the proper conveyance path P between the fixing and glossing devices 5 and 6 as shown in FIG. 11. This is particularly true where the recording sheet in use is relatively thick and forces the pressure roller 14 away from the fixing roller 12 upon entering the fixing nip N1, or has gloss-coated surfaces with low friction coefficient and thus slips off the roller surfaces forming the nip to cause variations in roller motor torque.

More preferably still, the controller 1 operates the third motor M3 at a rotation rate higher than that determined relative to the rotation rate of the second motor M2 for a predetermined period of time after a recording sheet reaches the glossing nip N2, so as to temporarily increase the processing speed VG of the glossing device 6 from a value originally determined relative to the processing speed VF of the fixing device 5. Such arrangement prevents print defects caused by recording sheets bending outward to interfere with adjacent surfaces and provides good sheet conveyance performance along the conveyance path P, since substantially increasing the processing speed VG of the glossing device 6 relative to the processing speed VF of the fixing device 5 (e.g., VG/VF exceeding 1.02) causes the fixing and glossing roller pairs to stretch and straighten a recording sheet between the fixing nip N1 and the glossing nip N2. It is desirable that accelerating the glossing roller motor M3 is only temporary, since pulling a recording sheet at both ends between the fixing and glossing nips N1 and N2 each with a high pressure thereacross results in additional loads on the roller motors, which, if maintained, may lead to a considerable increase in the motor torque required.

Specifically, the controller 1 temporarily increases the processing speed VG in the following steps S1 through S4, using a sensor 47 signaling the controller 1 when the leading edge of a recording sheet reaches a monitoring point between the fixing device 5 and the glossing device 6 along the conveyance path P.

First, the image forming apparatus 100 runs a test pass by operating the fusing device 5 and the glossing device 6 with the processing speed VG sufficiently greater than the processing speed VF to effect straightening of an incoming sheet therebetween, in which the controller 1 determines a period of time T required for the sheet to straighten out after the sensor 47 detects its arrival at the monitoring point between the fixing device 5 and the glossing device 6.

After the test run is completed, the image forming apparatus 100 then processes a recording sheet S for printing, which travels from downstream processes to the post-transfer conveyance path P. As the sensor 47 senses that the sheet S reaches the monitoring point past the fixing nip N1, the controller 1 increases the rotation rate of the third motor M3 by a given appropriate amount from the value initially specified relative to that of the second motor M2.

As the controller 1 maintains the increased rotation rate of the third motor M3 for the period of time T, the sheet S straightens out as it travels with one end pinched by the fixing nip N1 and the other end by the glossing nip N2. Then, after the time period T has elapsed, the controller 1 resumes the rotation rate of the third motor 3M to the initial value determined relative to the rotation rate of the second motor 2M.

Thus, the controller 1 accelerates the third motor 3M only for the minimum necessary period of time T during entry of the recording sheet S into the glossing nip N2. This effects a corresponding temporary increase in the conveyance speed VG, which allows the recording sheet S to reliably pass through the glossing nip N2 stretched substantially flat and taut without unduly increasing the motor torque during processing along the conveyance path P.

Further, the image forming apparatus 100 may control nip pressure at the glossing nip N2 in the non-gloss mode depending on the length of recording sheet S in process along the conveyance path P, as compared with a reference value Lref determined adaptively based on the dimensions of recording sheets accommodated in the image forming apparatus 100 as well as the layout or dimensions of components arranged along the conveyance path P, e.g., the distance L1 between the exit of the fixing nip N1 and the conveyance roller pair 7, and the distance L2 between the exit of the fixing nip N1 and the entrance of the glossing nip N2.

Specifically, when processing a recording sheet S shorter than the reference length Lref along the conveyance path P in the non-gloss mode, the controller 1 retracts the pressure roller 90 out of contact with the heat roller 80 by the pressure adjuster AG, so that the sheet S is drawn forward by the conveyor roller pair 7 after being driven by the fixing rollers 12 and 14.

Conversely, when processing a recording sheet S longer than the reference length Lref along the conveyance path P in the non-gloss mode, the controller 1 holds the pressure roller 90 in contact with the heat roller 80 with the pressure adjuster AG adjusting the nip pressure lower than that used in the gloss mode, so that the sheet S is drawn forward by the glossing rollers 80 and 90 after being driven by the fixing rollers 12 and 14.

As used herein, the reference length Lref denotes a value determined empirically or theoretically based on the dimensions of recording sheets in consideration of the layout dimensions L1 and L2 of the conveyance path P and other characteristics of the image forming apparatus 100.

For example, the reference length Lref may be set at approximately 257 mm, which equals the length of the longer edge of a B5-size copy sheet or that of the shorter edge of a B4-size copy sheet used in the image forming apparatus 100. In this case, during operation in the non-gloss mode, the controller 1 holds the pressure roller 90 against the heat roller 80 at a relatively low pressure by the pressure adjuster AG when processing a recording sheet shorter than 257 mm (e.g., an A4-size copy sheet conveyed with its shorter edge along the conveyance path P), and otherwise retracts the pressure roller 90 away from the heat roller 80 through the pressure adjuster AG.

In another example, the reference length Lref may be set at approximately 210 mm, which equals the length of the shorter edge of an A4-size copy sheet used in the image forming apparatus 100. In this case, during operation in the non-gloss mode, the controller 1 holds the pressure roller 90 against the heat roller 80 at a relatively low pressure by the pressure adjuster AG when processing a recording sheet shorter than 210 mm, and otherwise retracts the pressure roller 90 away from the heat roller 80 through the pressure adjuster AG.

In still another example, the reference length Lref may be set at approximately 200 mm, which does not equal the dimensions of commercially available copy sheets used in the image forming apparatus 100. This represents a case in which the reference length Lref is determined based on the layout dimensions of the conveyance path P, for example, by selecting a value greater than L2 and smaller than L1 when L1=210 mm and L2<182 mm. In this case, during operation in the non-gloss mode, the controller 1 holds the pressure roller 90 against the heat roller 80 at a relatively low pressure by the pressure adjuster AG when processing a recording sheet shorter than 200 mm (e.g., a B5-size copy sheet conveyed with its shorter, 182-mm edge along the conveyance path P). Conversely, the controller 1 retracts the pressure roller 90 away from the heat roller 80 through the pressure adjuster AG when processing a recording sheet longer than 200 mm (e.g., an A4-size copy sheet conveyed with its shorter, 210-mm edge along the conveyance path P).

In yet still further example, the reference length Lref may be determined as a threshold, e.g., approximately 210 mm, for preventing a recording sheet from creasing or other print defects caused by loosening or tightening between the fixing and glossing nips N1 and N2 both applying certain nip pressures to the incoming sheet, which does not exceed the distance L1 between the exit of the fixing nip N1 and the conveyance roller pair 7.

Consider a case where the image forming apparatus 100 accommodates an A3-size sheet of relatively thin paper weighing below 80 g/m$^2$, which can develop minute creases by being pinched at both ends, one by the fixing nip N1 and the other by the glossing nip N2, when the roller pairs rotate with little if any difference between their rotating speeds. In this case, during operation in the non-gloss mode, the controller 1 retracts the pressure roller 90 away from the heat roller 80 through the pressure adjuster AG when processing a relatively thin, A3-size paper sheet, which then passes between the glossing rollers 80 and 90 without pressure applied with its leading edge reaching the conveyance roller pair 7 and trailing edge still in the fixing nip N1.

Thus, the image forming apparatus 100 enables reliable conveyance of various types of recording sheets by controlling nip pressure at the glossing nip N2 in the non-gloss mode depending on whether the length of recording sheet S in process along the conveyance path P is longer or shorter than the reference value Lref. In particular, setting the threshold Lref for crease prevention allows a relatively large and thin recording sheet to travel along the conveyance path P reliably without creasing between the fixing and glossing nips N1 and N2, while ensuring good image quality by preventing the printed face of the sheet from interfering with the adjacent surface of the glossing roller.

Preferably, the gap between the heat roller 80 and the pressure roller 90 does not exceed 2 mm when establishing substantially no pressure therebetween. This ensures recording sheets to follow the proper conveyance path P, and prevents paper jams at the glossing nip N2 which can occur when the roller gap is excessively large.

Still preferably, the heat roller 80 and the pressure roller 90 have their outer surfaces coated with release agent such as fluorocarbon resin coating. This not only ensures good stripping of recording sheets from the roller surfaces, but prevents distortion and other print defects which would otherwise occur when passing a recording sheet thorough the gap between the glossing rollers 80 and 90 causes the printed face to accidentally touch the surface of the heat roller 80.

Yet still preferably, the glossing device 6 is disposed with respect to the fixing device 5 so that the distance L2 between the exit of the fixing nip N1 and the entrance of the glossing nip N2 be in a range equal to or greater than 50 mm, such as a length ranging from approximately 60 mm to approximately 182 mm, preferably ranging from approximately 70 mm to approximately 150 mm, and more preferably ranging from approximately 80 mm to approximately 100.

The lower limit of the nip-to-nip distance L2 may be determined depending on the characteristic of the image forming apparatus 100, such as in terms of configurations of the fixing nip N1 and the glossing nip N2 with respect to adjacent structures.

For example, setting a nip-to-nip distance L2 below 50 mm is undesirable because closely spacing the fixing and glossing devices 5 and 6 relative to each other results in steep angles of the guide plates 45, designed to define inlet and outlet openings of given dimensions therebetween, with respect to the conveyance path P, which results in malfunctioning of the guide plates 45 eventually causing paper jams between the fixing and glossing nips N1 and N2.

Also, the upper limit of the nip-to-nip distance L2 may be determined based on a minimum length of recording sheet accommodated along the conveyance path P in the image forming apparatus 100.

For example, the nip-to-nip distance L2 may be set to approximately 182 mm or shorter when the image forming apparatus 100 accommodates B5-size copy sheets with their shorter edges along the conveyance path P. Similarly, the nip-to-nip distance L2 may be set to approximately 150 mm or shorter for processing half letter-size copy sheets with their shorter edges along the conveyance path P, and to approximately 100 mm or shorter for processing postcards with their shorter edges along the conveyance path P.

Moreover, the nip-to-nip distance L2 may be set to approximately 210 mm or shorter for processing A4-size copy sheets with their shorter edges along the conveyance path P, to approximately 257 mm or shorter for processing B5-size copy sheets with their longer edges along the conveyance path P, in which cases the distance L1 between the exit of the fixing nip N1 and the conveyance roller pair 7 has an upper limit adjusted in accordance with the upper limit of the nip-to-nip distance L2.

Thus, the image forming apparatus 100 can reliably provide two modes of printing with desired appearances, i.e., higher smoothness and gloss for the gloss mode, and lower smoothness and gloss for the non-gloss mode, while enabling adjustment of gloss levels depending on various operational conditions by adjusting the pressures across the fixing nip N1 and the glossing nip N2, respectively.

Now consider specific examples of operation where the image forming apparatus 100 performs printing by controlling the fixing device 5 and the glossing device 6 in different manners depending on the mode of operation selected for specific types of recording medium and image attributes, as well as the size of recording medium accommodated in the post-transfer conveyance path P designed with a distance L1 between the exit of the fixing nip N1 and the conveyance roller pair 7 of 210 mm and a distance L2 between the exit of the fixing nip N1 and the entrance of the glossing nip N2 ranging from 60 to 182 mm.

For example, to print a coated paper sheet S with a gloss of approximately 30% to approximately 50%, the image forming apparatus 100 forms a toner image on the glossy sheet S through electrophotographic imaging processes, and forwards it into the conveyance path P for subsequent fixing and glossing through the fixing device 5 and the glossing device 6 in the gloss mode as follows.

First, the fixing device 5 heats the fuser belt 11 to an appropriate processing temperature through conduction from the heat roller 15 internally heated with the heater 15*h*, while creating a fixing nip N1 of a relatively large width by adjusting the pressure between the fixing rollers 12 and 14 to an appropriate range of approximately 15 to approximately 30 N/cm$^2$ with the pressure adjuster AF.

As the recording sheet S with the powder toner image thereon passes through the fixing nip N1, heat and pressure causes the toner to completely fuse and settle on the sheet surface while exhibiting a level of gloss of 25% or greater. After the fixing process, the recording sheet S advances to the pressure device 6 with the guide plates 45 correcting bents and curls of the sheet S during passage along the conveyance path P.

The glossing device 6 heats the surface of the heat roller 80 to an appropriate processing temperature of approximately 80° to 100° C., while creating a glossing nip N2 of a relatively large width by adjusting the pressure between the glossing rollers 80 and 90 to an appropriate range of approximately 15 to approximately 30 N/cm$^2$ with the pressure adjuster AG.

As the recording sheet S with the toner image now fixed passes through the glossing nip N2, heat and pressure causes the toner layer to superficially re-melt and smoothen to exhibit a higher level of gloss substantially equal to that of the coated surface of the recording sheet S, with a difference of gloss between the image and non-image areas within ±15%, and preferably ±10%. After the glossing process, the recording sheet S proceeds along the guide plates 95 to between the conveyance rollers 7, which then forwards the incoming sheet S for subsequent traveling through the conveyance path toward the ejection unit 8 for user pickup.

To print a plain paper sheet S with its length shorter than 210 mm, the image forming apparatus 100 forms a toner image on the sheet S through electrophotographic imaging processes, identifies the size of sheet S, and forwards it into the conveyance path P for subsequent fixing through the fixing device 5 in the non-gloss mode as follows.

First, the fixing device 5 heats the fuser belt 11 to an appropriate processing temperature through conduction from the heat roller 15 internally heated with the heater 15*h*, while creating a fixing nip N1 of a relatively small width by adjusting the pressure between the fixing rollers 12 and 14 to an appropriate range of approximately 15 to approximately 30 $N/cm^2$ with the pressure adjuster AF. Here, the pressure and width of the fixing nip N1 can become as high as those uses in the gloss mode where the sheet S in use is relatively thick.

As the recording sheet S with the powder toner image thereon passes through the fixing nip N1, heat and pressure causes the toner to completely fuse and settle on the sheet surface while exhibiting no or limited level of gloss. After the fixing process, the recording sheet S advances to the pressure device 6 with the guide plates 45 correcting bends and curls of the sheet S during passage along the conveyance path. P.

The glossing device 6 heats the surface of the heat roller 80 to an appropriate processing temperature of approximately 80° to 100° C., while creating a glossing nip N2 of a relatively small width by adjusting the pressure between the glossing rollers 80 and 90 to a sufficiently low range, for example, below approximately 5 $N/cm^2$, with the pressure adjuster AG.

As the recording sheet S with the toner image now fixed passes through the glossing nip N2, the glossing rollers 80 and 90 only drive the incoming sheet S forward along the conveyance path P without applying too much heat and pressure, which would impart the toner layer with additional gloss. After passing through the glossing device 6, the recording sheet S proceeds along the guide plates 95 to between the conveyance rollers 7, which then forwards the incoming sheet S for subsequent traveling through the conveyance path toward the ejection unit 8 for user pickup.

To print a plain paper sheet S with its length longer than 210 mm, the image forming apparatus 100 forms a toner image on the sheet S through electrophotographic imaging processes, identifies the size of sheet S, and forwards it into the conveyance path P for subsequent fixing through the fixing device 5 in the non-gloss mode as follows.

First, the fixing device 5 heats the fuser belt 11 to an appropriate processing temperature through conduction from the heat roller 15 internally heated with the heater 15*h*, while creating a fixing nip N1 of a relatively small width by adjusting the pressure between the fixing rollers 12 and 14 to an appropriate range of approximately 15 to approximately 30 $N/cm^2$ with the pressure adjuster AF. Here, the pressure and width of the fixing nip N1 can become as high as those usec in the gloss mode where the sheet S in use is relatively thick.

As the recording sheet S with the powder toner image the/eon passes through the fixing nip N1, heat and pressure causes the toner to completely fuse and settle on the sheet surface while exhibiting no or limited level of gloss. After the fixing process, the recording sheet S advances to the pressure device 6 with the guide plates 45 correcting bends and curls of the sheet S during passage along the conveyance path P.

The glossing device 6 retracts the pressure roller 90 away from the heat roller 80 with the pressure adjuster AG to create a gap of approximately 2 mm or smaller between the glossing rollers 80 and 90, through which the recording sheet S with the toner image now fixed passes along the conveyance path P with substantially no heat and pressure applied, which would impart the toner layer with additional gloss. After passing through the glossing device 6, the recording sheet S proceeds along the guide plates 95 to reach between the conveyance rollers 7 with its trailing end still in the fixing nip N1. The conveyance roller pair 7 then forwards the incoming sheet S for subsequent traveling through the conveyance path toward the ejection unit 8 for user pickup.

The combination of fixing device 5 and glossing device 6, the former having a nip dwell time of approximately 30 msec or longer, and preferably approximately 60 msec or longer, and the latter having a nip dwell time of approximately 15 msec in the gloss mode, allows for producing high yields in the gloss mode as well as in the non-gloss mode, leading to consistently high productivity of the image forming apparatus 100 in both modes of operation.

Having the series of fixing device 5 and glossing device 6 both with adjustable nip pressure and width enables the image forming apparatus 100 to switch between the gloss and non-gloss modes without requiring dedicated post-transfer conveyance paths for fixing in both operation modes, leading to compact configuration of the fixing process and overall size reduction of the image forming apparatus.

Moreover, adjusting nip pressure and width in the fixing device and the glossing device allows for printing a wide range of recording media with desired appearance and gloss in both modes of operation. Further, creating and removing the glossing nip depending on the length of recording sheet relative to the dimensions of the conveyance path. P ensures reliable sheet conveyance downstream of the fixing process without affecting appearance of image printed in the non-gloss mode.

Numerous additional modifications and variations are possible in light of the above teachings. For example, although the fixing device is described as being incorporated in the multicolor printer, the fixing device according to this patent specification is applicable to various types of electrophotographic image forming apparatus, such as monochrome printers, photocopiers, facsimiles, or multifunctional machines incorporating several of these imaging functions.

Further, although the image forming apparatus uses the fixing device in combination with the glossing device in several embodiments described herein, the fixing device according to this patent specification may be used alone or in combination with a secondary fixing device instead of a glossing device to complete fixing process along the post-transfer conveyance path.

It is therefore to be understood that, within the scope of the appended claims, the disclosure of this patent specification may be practiced otherwise than as specifically described herein.

What is claimed is:

1. An image forming apparatus comprising:

an electrophotographic imaging unit to form a toner image on a recording medium;

a fixing device to fix the toner image in place on the recording medium traveling along a conveyance path, the fixing device including:

a fuser member defining a first heatable surface rotatable to convey the recording medium therealong;

a pressure member defining a second heatable surface rotatable to convey the recording medium therealong;

a first motor connected to the fuser member to rotate at a first rotation rate to drive the first surface at a first conveyance speed;

a second motor connected to the pressure member to rotate at a second rotation rate to drive the second surface at a second conveyance speed;

a pressure adjuster disposed adjacent to the pressure member to press the pressure member against the fuser member at a variable pressure to form a fixing nip with a variable width extending along the conveyance path, the fuser and pressure members together passing the recording medium through the fixing nip to fix the toner image thereon with heat and pressure; and a controller connected to the first and second motors to adjust at least one of the first and second rotation rates relative to the other to keep the first and second conveyance speeds substantially equal to each other; and a glossing device disposed downstream from the fixing device along the conveyance path to provide a gloss on the toner image after fixing, the glossing device including a pair of first and second rotatable glossing members, at least one of the first and second glossing members being heated, and at least one of the first and second glossing member being pressed against the other at a variable pressure to form a glossing nip of a variable width extending along the conveyance path through which the recording sheet passes under heat and pressure to gloss the toner image, wherein the glossing device includes a third motor, separate from the first and second motors of the fixing device, connected to the controller and a selected one of the first and second glossing members, to rotate at a third rotation rate to drive the selected one of the first and second glossing members at a third conveyance speed, wherein the controller adjusts at least one of the second and third motor rotation rates relative to each other to maintain a specific ratio range between the second and third conveyance speeds, and wherein the controller adjusts the second and third motor rotation rates based on at least one of surface temperature of the pressure member, and surface temperature of the selected one of the first and second glossing members.

2. The image forming apparatus according to claim 1, wherein the controller regulates a difference between the first and second conveyance speeds to within approximately 1% of each other.

3. The image forming apparatus according to claim 1, wherein the glossing device is operable in a gloss mode and a non-gloss mode, the glossing device presses and drives the recording medium by holding the first and second glossing members at a relatively high pressure in the gloss mode, and the glossing device drives without pressing the recording medium by holding the first and second glossing members at a relatively low pressure in the non-gloss mode.

4. The image forming apparatus according to claim 1, wherein the controller maintains a ratio of the third conveyance speed to the second conveyance speed within a range of from approximately 1.00 to approximately 1.02.

5. The image forming apparatus according to claim 1, wherein the controller adjusts at least one of the first and third motor rotation rates relative to each other to maintain a specific ratio range between the first and third conveyance speeds.

6. The image forming apparatus according to claim 1, wherein the controller adjusts the first through third motor rotation rates relative to each other based on at least one of thickness and friction coefficient of the recording medium.

7. The image forming apparatus according to claim 1, wherein the controller temporarily accelerates the third motor to increase the third conveyance speed from an initial level at least during a specified period of time after a recording medium enters the glossing nip.

8. The image forming apparatus according to claim 7, wherein the controller decelerates the third motor to resume the initial level of the third conveyance speed upon lapse of the specified period of time.

9. An image forming apparatus comprising:

an electrophotographic imaging unit to form a toner image on a recording medium;

a fixing device to fix the toner image in place on the recording medium traveling along a conveyance path, the fixing device including:

a fuser member defining a first heatable surface rotatable to convey the recording medium therealong;

a pressure member defining a second heatable surface rotatable to convey the recording medium therealong;

a first motor connected to the fuser member to rotate at a first rotation rate to drive the first surface at a first conveyance speed;

a second motor connected to the pressure member to rotate at a second rotation rate to drive the second surface at a second conveyance speed;

a pressure adjuster disposed adjacent to the pressure member to press the pressure member against the fuser member at a variable pressure to form a fixing nip with a variable width extending along the conveyance path, the fuser and pressure members together passing the recording medium through the fixing nip to fix the toner image thereon with heat and pressure; and a controller connected to the first and second motors to adjust at least one of the first and second rotation rates relative to the other to keep the first and second conveyance speeds substantially equal to each other; and a glossing device disposed downstream from the fixing device along the conveyance path to provide a gloss on the toner image after fixing, the glossing device including a pair of first and second rotatable glossing members, at least one of the first and second glossing members being heated, and at least one of the first and second glossing member being pressed against the other at a variable pressure to form a glossing nip of a variable width extending along the conveyance path through which the recording sheet passes under heat and pressure to gloss the toner image, wherein the glossing device includes a third motor, separate from the first and second motors of the fixing device, connected to the controller and a selected one of the first and second glossing members, to rotate at a third rotation rate to drive the selected one of the first and second glossing members at a third conveyance speed wherein the controller adjusts at least one of the first and third motor rotation rates relative to each other to maintain a specific ratio range between the first and third conveyance speeds, wherein the controller adjusts the first and third motor rotation rates based on at least one of surface temperature of the fuser member, and surface temperature of the selected one of the first and second glossing members.

10. The image forming apparatus according to claim 9, wherein the controller maintains a ratio of the third conveyance speed to the first conveyance speed within a range of from approximately 1.00 to approximately 1.02.

* * * * *